US009980553B2

(12) United States Patent
Balz et al.

(10) Patent No.: US 9,980,553 B2
(45) Date of Patent: May 29, 2018

(54) TOOL ASSEMBLY COMPRISING UNIVERSAL HANDLE AND INTERCHANGEABLE TOOL HEADS

(71) Applicant: Ecolab USA Inc., Saint Paul, MN (US)

(72) Inventors: Eric R. Balz, Stillwater, MN (US); Eric Gingras, Herber City, UT (US); Scott Latimer, Flower Mound, TX (US); Jeremy B. Finison, Pine Hall, NC (US); Dan Anderson, Eagan, MN (US); Sarah Gilbertson, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days. days.

(21) Appl. No.: 14/996,993

(22) Filed: Jan. 15, 2016

(65) Prior Publication Data

US 2016/0207190 A1 Jul. 21, 2016

Related U.S. Application Data

(60) Provisional application No. 62/104,173, filed on Jan. 16, 2015.

(51) Int. Cl.
*B25G 3/30* (2006.01)
*B25G 1/00* (2006.01)
(Continued)

(52) U.S. Cl.
CPC ..... *A46B 5/0095* (2013.01); *A46B 7/044* (2013.01); *A46B 11/001* (2013.01); *A47L 13/42* (2013.01);
(Continued)

(58) Field of Classification Search
CPC ..... A46B 5/0095; B25G 3/00; B25G 3/02; B25G 3/04; B25G 3/08; B25G 3/10;
(Continued)

(56) References Cited

U.S. PATENT DOCUMENTS 798,172 A * 8/1905 Ducret ..... B25G 1/00 15/145
2,294,661 A * 9/1942 Hibbard ..... B25G 3/00 16/433
(Continued)

FOREIGN PATENT DOCUMENTS

DE 29604237 * 5/1996
DE 29721370 * 2/1998
(Continued)

OTHER PUBLICATIONS

Partial machine translation of DE 29604237, May 2, 1996.*
(Continued)

*Primary Examiner* — Mark Spisich
(74) *Attorney, Agent, or Firm* — McKee, Voorhees & Sease, PLC

(57) ABSTRACT

A tool assembly includes an elongated handle and a locking system for attaching a tool head to the handle. The tool head can be a floor care tool or other accessory that can be attached to the handle such that the elongated length of the handle can aid in the use of the tool attached. The locking system includes a keyed locking collar for engaging at least a first portion of the tool head, and a locking cap rotatably positioned on the handle for engaging a second portion of the tool head. The handle can be extendable, such as by telescoping, and can also be overmolded.

13 Claims, 47 Drawing Sheets

(51) Int. Cl.

| | |
|---|---|
| ***A46B 5/00*** | (2006.01) |
| ***B25G 3/20*** | (2006.01) |
| ***B25G 3/22*** | (2006.01) |
| ***B25G 3/12*** | (2006.01) |
| ***A46B 11/00*** | (2006.01) |
| ***A46B 7/04*** | (2006.01) |
| ***A47L 13/42*** | (2006.01) |

(52) U.S. Cl.
CPC ..... *B25G 1/00* (2013.01); *B25G 3/12* (2013.01); *B25G 3/20* (2013.01); *B25G 3/22* (2013.01); *B25G 3/30* (2013.01); *A46B 2200/302* (2013.01); *Y10T 16/469* (2015.01); *Y10T 403/7033* (2015.01); *Y10T 403/7098* (2015.01)

(58) Field of Classification Search
CPC ... B25G 3/12; B25G 3/18; B25G 3/20; B25G 3/22; B25G 3/24; B25G 3/30; Y10S 16/24; Y10S 16/25; Y10S 16/41; Y10T 16/469; Y10T 403/7026; Y10T 403/7033; Y10T 403/7035; Y10T 403/7098; Y10T 403/66; Y10T 403/67
USPC ..... 15/145, 176.1–176.3, 176.6; 16/422, 16/DIG. 24, DIG. 25, DIG. 41; 403/359.1, 359.5, 359.6, 383, 341, 342
See application file for complete search history.

(56) References Cited

U.S. PATENT DOCUMENTS

| | | | | | |
|---|---|---|---|---|---|
| 2,689,131 | A * | 9/1954 | Priest | B27G 15/00 | 144/241 |
| 3,682,516 | A * | 8/1972 | Savage | B25G 3/04 | 15/145 |
| 3,848,737 | A * | 11/1974 | Kenon | A63B 53/02 | 206/315.2 |
| 4,541,139 | A * | 9/1985 | Jones | B25G 3/22 | 15/145 |
| 4,642,837 | A | 2/1987 | Nichols et al. | | |
| 5,108,114 | A * | 4/1992 | Marx | A63B 49/035 | 16/422 |
| 5,172,447 | A * | 12/1992 | Tomm | A46B 5/0095 | 15/145 |
| 5,890,254 | A * | 4/1999 | Courtney | A46B 17/02 | 15/145 |
| 6,216,306 | B1 * | 4/2001 | Esterson | A46B 5/02 | 15/111 |
| 6,247,199 | B1 * | 6/2001 | Petner | A47L 13/24 | 15/145 |
| 8,397,338 | B2 | 3/2013 | Dihn | | |
| 8,561,245 | B2 | 10/2013 | Weis | | |
| 9,149,925 | B1 * | 10/2015 | Van Valin | B25G 1/102 | |
| 2009/0113651 | A1 * | 5/2009 | Giacolo | B25G 3/08 | 15/176.2 |
| 2015/0217440 | A1 * | 8/2015 | Levesque | B25G 3/30 | 403/341 |

FOREIGN PATENT DOCUMENTS

| | | | |
|---|---|---|---|
| EP | 655300 | * | 5/1995 |
| FR | 1159107 | * | 6/1958 |
| GB | 2201627 | * | 9/1988 |

OTHER PUBLICATIONS

Israel Patent Office, International Search Report and the Written Opinion, issued in connection to International Application No. PCT/US2016/013625, dated Apr. 18, 2016, 14 pages, dated Apr. 18, 2016.

* cited by examiner

TOOL ASSEMBLY COMPRISING UNIVERSAL HANDLE AND INTERCHANGEABLE TOOL HEADS

CROSS-REFERENCE TO RELATED APPLICATIONS

This application claims priority under 35 U.S.C. § 119 to provisional application Ser. No. 62/104,173, filed Jan. 16, 2015, which is herein incorporated by reference in its entirety.

FIELD OF THE INVENTION

The invention relates generally to the field of floor care and cleaning. More particularly, but not exclusively, the invention relates to floor care tools for use in cleaning floors.

BACKGROUND OF THE INVENTION

Floor care tools, such as mops, brooms, and other tools used to clean floors are used in a variety of home and commercial situations. The tools can range from brooms used to sweep up debris, to mops and other tools that are used with cleaners, such as liquid chemical solutions, in order to sanitize, disinfect, or otherwise provide a deeper clean for the floors.

Because of the variety of ways to clean floors, it may be required to have many different floor care tools. These can become costly. Furthermore, the tools, including the cleaning heads used with the tools, may need to be replaced often, as they are used frequently. The amount of tools necessary can create additional problems with storage and needing a large inventory to ensure that there are enough tools to fully clean floors, such as to meet industry cleanliness requirements. Still additional problems arise when using the tools with liquid products. For example, some tools require a liquid cleaner to be added to the floor and then spread with a tool. The application of the liquid prior to use with the tool can create hazards. When the application of the product is complete, a completely different floor care tool may be required. This can include a time consuming process of locating the next tool, storing the first, and then cleaning.

These same issues arise with other handheld tools, including but not limited to, painting or other application tools, yard tools, pool tools, and generally any other type of tool that is used in a handheld manner. The tools are specific such that it is expensive to have the right tools for each task, while also taking up space and not being as durable as desired.

Therefore, there is a need in the art for an improved tool that is more durable, includes fewer components, reduces mess involved with liquid products, and that can include modular or universal components to reduce the number of pieces that need to be stored and kept in stock.

SUMMARY OF THE INVENTION

Therefore, it is a primary object, feature, and/or advantage of the invention to overcome deficiencies in the art.

It is another object, feature, and/or advantage of the invention to provide a universal tool handle that can be attached to different tool members.

It is yet another object, feature, and/or advantage of the invention to provide a tool head, such as a floor tool head, that can be used with a variety of inserts to perform a plurality of operations, such as floor care operations.

It is still another object, feature, and/or advantage of the invention to provide more durable tools.

These and/or other objects, features, and advantages of the present invention will be apparent to those skilled in the art. The present invention is not to be limited to or by these objects, features and advantages. No single embodiment need provide each and every object, feature, or advantage.

According to an aspect of the invention, a universal handle for use with interchangeable tool heads is provided. Examples of suitable tool heads include but are not limited to floor care tools, painting tools, cleaning tools, material moving tools, yard tools, landscaping tools, scraping tools, and the like which can be operatively connected to the universal handle. In an embodiment, the universal handle can be attached to one or a variety of floor care tools for cleaning and taking care of a floor, such as by attaching a mop or broom thereto.

The universal handle includes an elongated, overmolded handle having first and second ends, a mounting member at the first end of the handle, and a locking system positioned at or near the second end of the handle. The locking system includes a keyed locking collar for engaging at least a first portion of the tool head, and a locking cap rotatably positioned on the handle for engaging a second portion of the tool head. The handle can also be used with a hanging system, which can include puck members mounted on a rail, to aid in storing the handle and tools such that tools are organized to reduce the amount of room for storage.

According to another aspect of the invention, a tool for use with a handle is provided. The tool includes a head member comprising a body and including first and second connection points for connecting the head member to the handle. In some embodiments, the head member further comprises an inner section capable of receiving a tool head insert or attachment, and an engaging member attachment operatively connected to the head member for selectively attaching one of a plurality of engaging members to the head member. The tool can also include additional members to provide additional features, such as a member added to allow the release of a cleaning solution to aid in the cleaning of a surface with the tool.

According to yet additional aspects of the invention, a tool assembly is provided. In an embodiment, the tool assembly is a floor care tool assembly for use with cleaning floors. The assembly includes a universal handle comprising an elongated, overmolded handle having first and second ends, and a locking system positioned at or near the second end of the handle, the locking system comprising a keyed locking collar for engaging at least a first portion of the tools and a locking cap rotatably positioned on the handle for engaging a second portion of the tool, and a tool operatively attached to the universal handle. In embodiments, the tool comprises a head member comprising a body and including first and second connection points for connecting the head member to the universal handle. The tool can further include an engaging member attachment operatively connected to the head member for selectively attaching one of a plurality of engaging members to the head member.

Additional aspects of the assembly can include a mounting member positioned at or near the first end of the universal handle and configured to be mounted into a mounting puck for storage.

Figure 1:
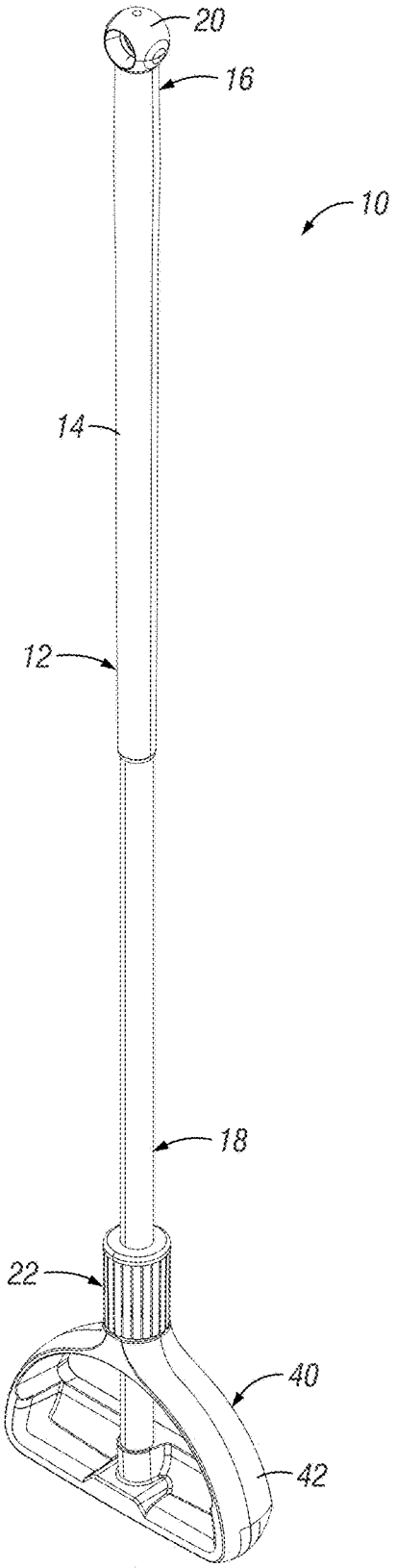
FIG. 1 is a perspective view of a tool assembly including a universal handle and a floor care tool head.
Figure 2:
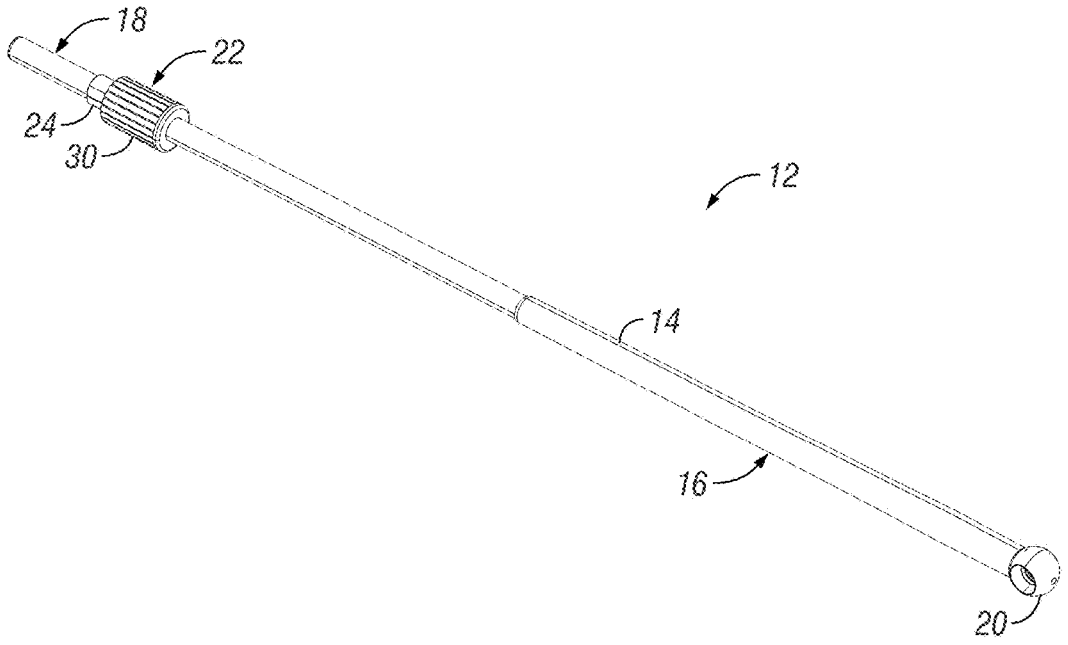
FIG. 2 is a perspective view of a universal handle for attaching to a tool head.
Figure 3:
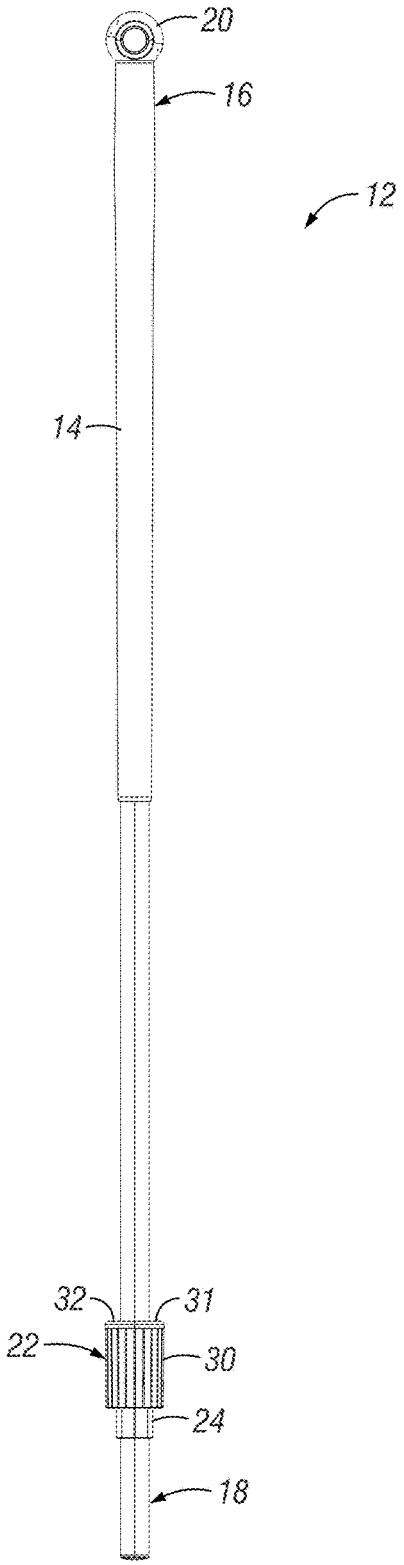
FIG. 3 is a front plan view of the universal handle.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENTS

The invention is directed towards a variety of cleaning and/or care tools that provide greater durability and wider use than those previously in the market. According to some aspects of the disclosure, the tools provide increased durability including a replaceable insert design. Furthermore, it will be appreciated that various types of tools, including floor care tools, can be used and are intended to be included as part of the invention. For example, the general concepts and aspects of the invention can be used with floor care tools including push brooms, squeegees, angle brooms, deck brushes, mops, combinations, and the like. It should be appreciated, while specific bristles and types of brushes may not be included in all of the figures of the invention, the inventions provide a modular and/or generally universal type of floor care handle and tool head such that the different types of floor care tools could be swapped out with one another to account for varying intended uses of the tools. Therefore, as will be appreciated, the invention provides, according to at least some aspects, a generally universal type of floor care tool in which an insert can be swapped out of a floor care tool head, such as to provide increased use of a product, while decreasing the amount of space needed to store the different tools.

Furthermore, it should be appreciated that the disclosure contemplates that the various handles of the disclosure be interchangeable with tools and/or tool heads in general. As will be understood, the tools attached to the handle of the disclosure need not be used only for floor care. Many applications and tools can be considered to be part of the disclosure. Such other applications include, but are not limited to, cleaning, painting, scraping, application processes, removal processes, material moving (e.g., shoveling), yard tools, landscaping tools, and the like, which can be operatively connected to the various handles of the disclosure in order to aid in the selected application associated with the tool head attached to the handle. As will be understood, the handle of the disclosure will provide a near universal and improved connecting system to allow for the tools to be used in confidence with said handle.

Therefore, FIG. 1 is a view of a tool assembly 10 according to aspects of the disclosure. The assembly 10 shown in FIG. 1 includes a handle 12 connected to a tool 40, which for exemplary purposes is a floor care tool. The handle 12 may be known as a generally universal type handle in which various sizes, shapes, types, or the like of tools can be selectably attached to said handle 12. For example, while the handle 12 is shown throughout the figures to be of a certain length, it is to be contemplated that shorter lengths be utilized and connectable to the various tool heads to allow for different amount of leverage, torque, or other movement that can aid in the application being done with the handle/tool combination. As will be understood, the handle 12 provides improvements over previous types of handles and tool assemblies such that the handle will provide for greater durability and support for use with a tool, such as those shown and described herein.

The handle 12 is shown in various stages in FIGS. 2-5. The handle 12 includes an elongated cylindrical shaft member having a first end 16 and a second end 18. The elongated portion can be an overmolded, one-piece plastic cylinder such that the outer portion, which may be a grip 14, is overmolded over a piece of rigid material, such as a rigid cylindrical member. The overmolding process can include the use of over-molding plastic on a rigid cylindrical member such as metal, plastic, composite material, or some combination thereof. The grip portion 14, may be a plastic, rubber, or other material, and could be included with the handle 12 in order to aid in the grip thereof. Furthermore, the overmolded portion can extend generally any length of the handle 12. Still further, the portion 14 need not be overmolded, and instead could be attached or fixed (either permanently or temporarily) to the handle 12. Examples of types of attachment can be, but are not to be limited to, rivets, friction fit, screws, adhesives, pins, dowels, snaps, key slots, eye bolts, and the like. Generally any manner that can hold the portion 14 in place relative to the handle 12 is contemplated to be part of the invention.

Figure 6:
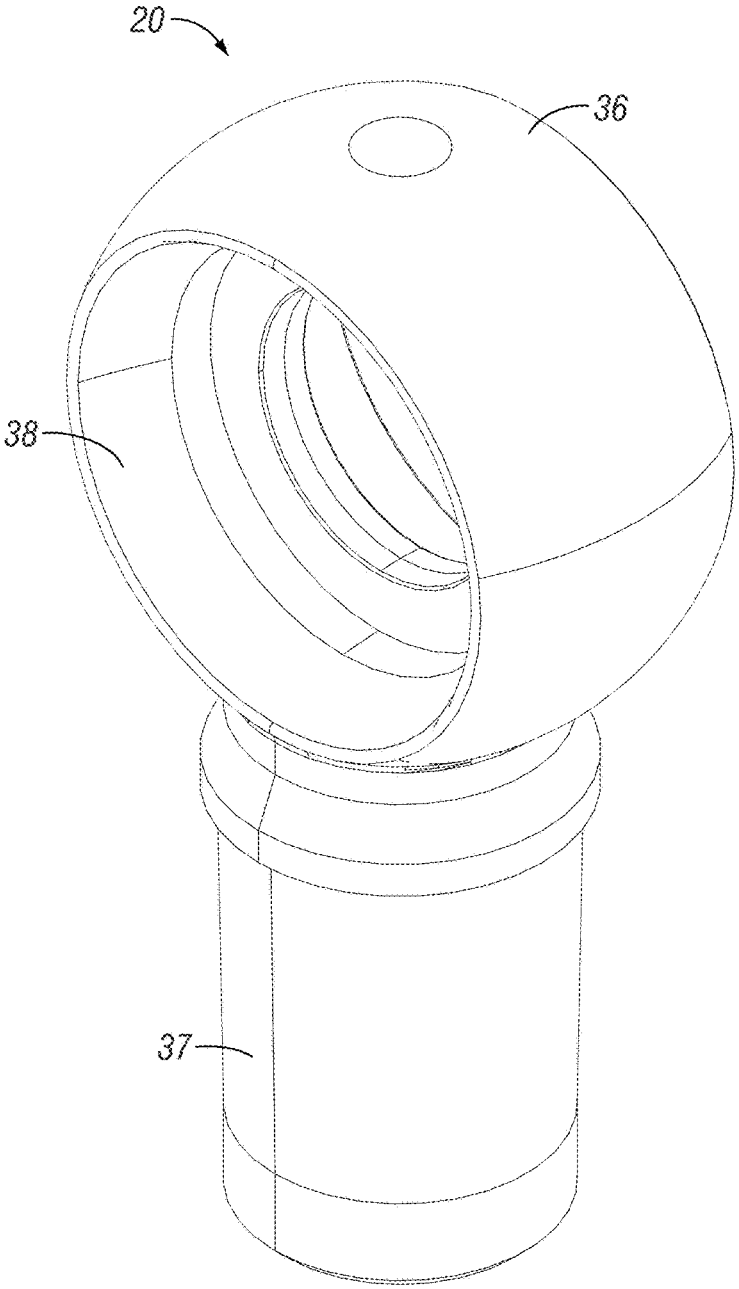
FIG. 6 is a view of a mounting member used with the universal handle.

The overmolding process also includes an overmolded section of a mounting member 20, which is positioned generally at the first end 16 of the handle 12. The mounting member 20, shown in greater detail in FIG. 6, includes a generally spherical or ball-shaped member 36 attached to and an extending cylindrical member 37. The spherical portion 36 includes an aperture 38 therethrough, as well as portions of the sphere being cut away. The mounting member 20 includes shapes such that the member provides for gripping and/or storing features. For example, as will be understood and shown in FIGS. 31-35, the mounting member 20 can be shaped to coincide with a mounting assembly, such as a puck member. While the mounting member 20 and the puck member 190 are shown to have spherical shapes (e.g., ball and socket configurations), it should be appreciated that any shape, size, and/or configuration of the mounting member and corresponding puck can be utilized. For example, the mounting member may comprise a square, triangle, rectangular, oval, quadrilateral, circular, symmetric or asymmetric, or generally any other geometrical shape that may aid in use of the device. The puck member 190 can have a correspondingly-shaped portion to receive the shaped mounting member 20. Such a common or similar shape in size between the mounting member 20 of the handle 12 and the portion of the puck 190 will allow the handle, and thus tool assembly 10, to be affixed to the puck such that the tool assembly 10 can be stored thereat.

Figure 4:
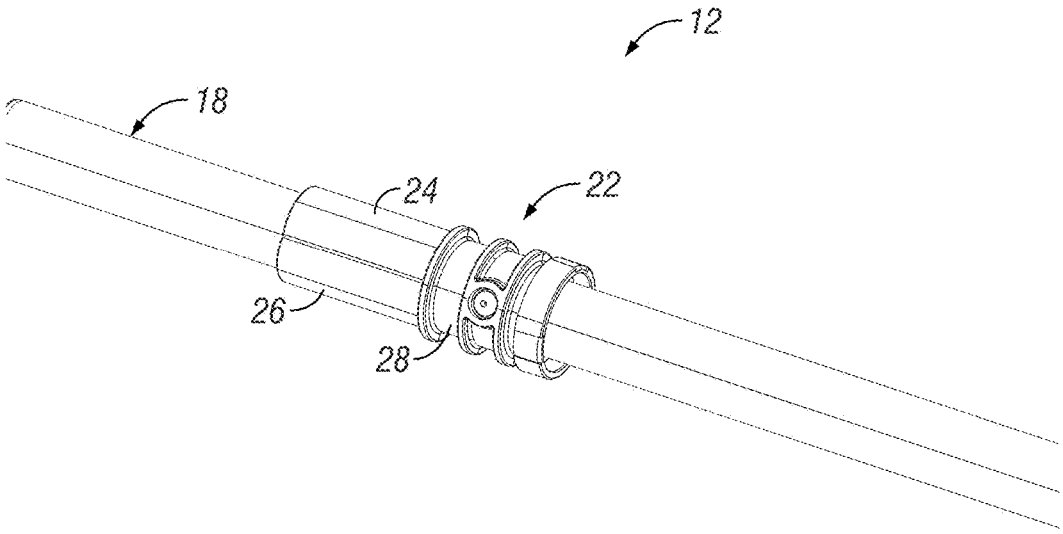
FIG. 4 is a view of a locking collar positioned on the universal handle.

Positioned generally at or near the second end 18 of the handle 12 is a locking system 22 for at least temporarily affixing the handle 12 to one of the tools included and/or referenced in the invention. The locking system 22 includes a keyed locking collar 24 and locking cap 30. The keyed locking collar 24 is positioned at least partially surrounding the elongate portion of the handle 12. As shown in FIG. 4, the keyed locking collar 24 includes a portion with a detent 26 positioned thereon. A detent is a recessed portion of a generally cylindrical portion of the locking collar 24, which will aid in alignment between the handle 12 and one of the tools. For example, the detent 26 of the keyed collar 24 will coincide with a keyed aperture of the tools such that the handle will only be able to be inserted in a certain or predefined orientation through a portion of the tool. This will aid in alignment of the handle relative to the tool and can be useful when certain angles are appropriate between the tools and the handle. For example, some tools for floor care may be best used when the handle is at a predetermined or predefined angle relative to the tool. This will allow for a more ergonomic use of the tool, and will provide other benefits as well. Thus, to ensure that the handle 12 is positioned at the determined angle, the detent can be positioned on the keyed locking collar 24 such that the handle 12 can only be attached to the tool when the detent is aligned with a corresponding aperture of the tool. This will provide or ensure for proper alignment and use of the tool.

Furthermore, while only one detent is shown in FIG. 4 for use with the keyed locking collar 24, it should be appreciated that additional detents may be radially spaced on the locking collar 24. Additional detents can align with the keyed aperture of the tool to provide for different preset angular variations of the handle and tool combination. Thus, the inclusion of additional detents radially spaced on the keyed locking collar will allow for a user adjustable change in the angle between the handle 12 and the tool head. This change can be useful for different tools, different abilities of a user, different sizes of users, different methods of using, and the like, with the result being a quick and present change in which the handle will not be in an in-between angle which is awkward or otherwise preferred for use for the tool assembly.

Additional aspects of the keyed locking collar 24 include grooves 28 positioned around. The grooves are configured to correspond with an overlapping locking cap 30, as will be understood, in order to allow for the locking cap 30 to rotate relative to the locking collar 24 without the locking collar being required to move itself. As shown in FIG. 4, the locking collar 24 may be affixed to the elongate portion of the handle 12, such as by inserting a pin, screw, or other member through a portion of both the locking collar 24 and the elongate shaft of the handle 12. This member can provide that the locking collar not rotate (or have little rotation) relative to the handle 12. This will also aid with the detent member for providing that the detent is in the proper location for aligning the handle relative to the tool, as has been previously disclosed. Thus, the keyed locking collar 24 at least partially surrounds a portion of the elongate shaft of the handle 12 and is affixed in location thereat via the pin, screw, or other locking member.

Figure 5:
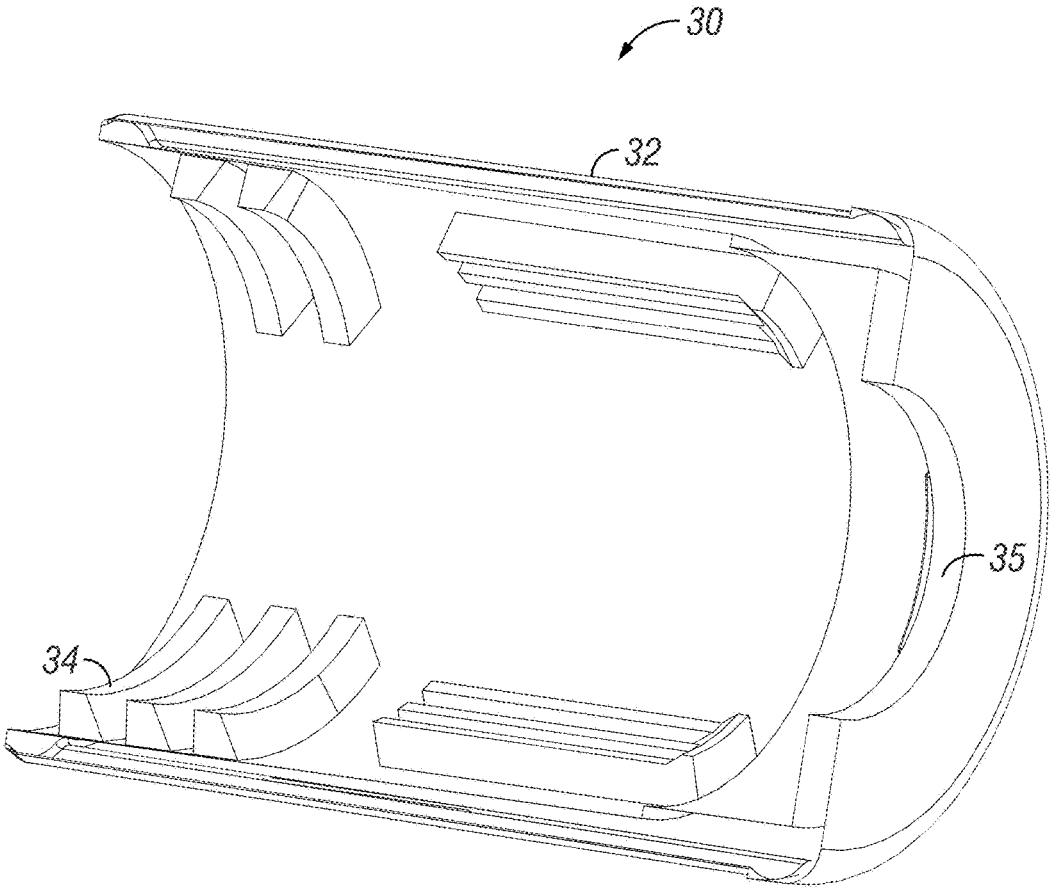
FIG. 5 is a sectional view of a locking cap used with the universal handle.

The locking cap 30 is then positioned at least partially surrounding both the elongate shaft of the handle 12 and at least a portion of the locking collar 24. The locking cap 30 can include first and second portions 31, 32, which are joined together to surround portions of both the shaft of the handle 12 and a portion of the locking collar 24. The interior of a second portion 32 of the locking cap 30 is shown in FIG. 5. The first and second portions are generally mirror images of one another. Therefore, the second portion 32 shown in FIG. 5 includes protrusions 34, which will interact with a threaded portion of a tool connection point, so as to connect and lock the handle to the tool at the connection point. Additional protrusions of the interior of the locking member 30 will prevent over-tightening of the locking member relative to the tool. Furthermore, an aperture 35 can be configured to receive a portion of the elongate shaft of the handle 12 so as to further allow for rotation of the locking member 30 relative to the handle 12 and keyed collar 24. For example, the threaded protrusions 34 shown in FIG. 5 are configured to reside within or at least partially within a groove 28 of the keyed collar 24 as shown in FIG. 4. The groove will also aid in preventing longitudinal movement of the locking cap 30 relative to the locking collar 24 and/or handle 12. Therefore, the locking cap 30 will only be rotatable about its general position and will not generally be able to be moved axially or longitudinally. As will be understood, this will aid in providing a more durable connection between the handle 12 and a floor care tool attached thereto.

Therefore, it is to be appreciated that the handle 12 of the tool assembly 10 is a more durable handle than those previously known, and will provide numerous benefits and/or advantages thereto. The over-molded sections of the elongate shaft of the handle 12 will provide for greater rigidity including greater strength and durability of the handle 12. The mounting member 20 positioned generally at the end of the handle 12 will provide a gripping portion that can also be used to mount and/or store the handle and/or assembly when not in use, while taking up less room than those previously used. Furthermore, a locking system 22 positioned on a portion of the handle 12 shaft will provide for multiple connection points between the handle and a tool such that the resulting assembly will be of greater durability than those previously known. Furthermore, the locking system 22 will provide two points of contact and attachment between the handle 12 and a tool for superior durability. The lock and keyed aspects of the locking cap 30 and collar 24 will prevent or otherwise mitigate rotation between the tool and the handle 12. The keyed aspects also increase the directional alignment, such as in the case where a bent handle shape is desired. Furthermore, this could be used to match specific handles and tool heads to provide lockout between them such that a wrong or unwanted handle is not utilized with certain tool heads. Additional advantages obvious to those skilled will be apparent and are intended to be included as part of the invention.

FIGS. 1 and 7-9 show aspects of a floor care tool assembly 10 according to the disclosure. As will be understood, the disclosure provides numerous examples of aspects and/or embodiments of different tool types, including but not limited to, floor care tools and the like.

Attached to the handle 12 in FIG. 1 is a floor care tool 40, which may be known as a deck brush tool. The floor care tool 40 includes a tool head 42 having a body 44. The body 44 of the tool head 42 is formed generally in A-frame shape. The A-frame shape includes arched walls extending from a bottom portion and convening generally at a second connection point 48. Positioned on or at the bottom portion is a first connection point 46. The tool head 42 includes the two points of connection 46, 48 to coincide with portions of the handle 12, as has been shown and discussed. For example, the second end 18 of the handle 12 will be extended through the keyed aperture at the second connection point 48 into the aperture at the first connection point 46. As shown in the figures, the first connection point 46 includes a receiving aperture and can include protrusions 47, which may be notches, threads, splines, or other ridges or members. For example, it is contemplated that the second end 18 of the handle 12 includes external threads which are engageable with internal threads of the first connection point 46. Therefore, once the handle is inserted into the connection point 46, the handle 12 can then be rotated to provide a first means of attachment to the tool 40 at said connection point 46. Furthermore, interlocking members may be included that will mitigate the ability of the handle 12 to rotate relative to the tool 40. However, it should also be appreciated that the first connection point 46 could also be a substantially hollow to receive a portion of the handle without any locking or connection features. The splines could be used, however, to space the end of the handle from the bottom of the connection point, such as to ensure a desired length for the tool. This is shown in FIG. 8, where radially spaced splines are included in the tool head 42 to space the end of the handle from the bottom of the first connection point a distance defined by the length of the splines.

Furthermore, the tool 40 includes a second connection point 48. The second connection point 48 is positioned generally at an upper end of the tool 40. The second connection point 48 includes an external connection member 49, which may be threads or other engaging members. The second connection point 48 is engageable with the locking cap 30 of the handle 12. Thus, once the handle has been inserted through the second connection point and connected at the first connection point 46. The locking cap 30 can be rotated relative to the handle to engage the internal threads of the locking cap 30 to the external threads or locking members 49 of the second connection point 48. Providing the two distinct connection points between the handle 12 and the floor care tool 40 provides for greater stability and durability of the tool assembly 10. It will also aid in preventing unwanted rotation of the handle relative to the floor care tool 40, which may occur when only a single connection is formed, such as by rotating an end of the handle into the first connection point 46, as is the case with traditional floor care tools. Furthermore, while threads have been disclosed as being the connection between the handle and the floor care tool 40 at the connection points 46, 48, it should be appreciated that other forms of connection can be included and the invention is not to be limited to that specifically disclosed. For example, the handle can be inserted through and into the connection points and a pin be inserted via an aperture in both the floor care tool and portions of the handle. The pin can lock the handle in place relative to the floor care tool 40 at both the first and second connection points, or at one of the first or second connection points to prevent rotation of the handle relative to the floor care tool. Furthermore, combinations of a pin and threaded portions can be utilized at one or both of the connection points between the handle 12 and the floor care tool 40.

Figure 8:
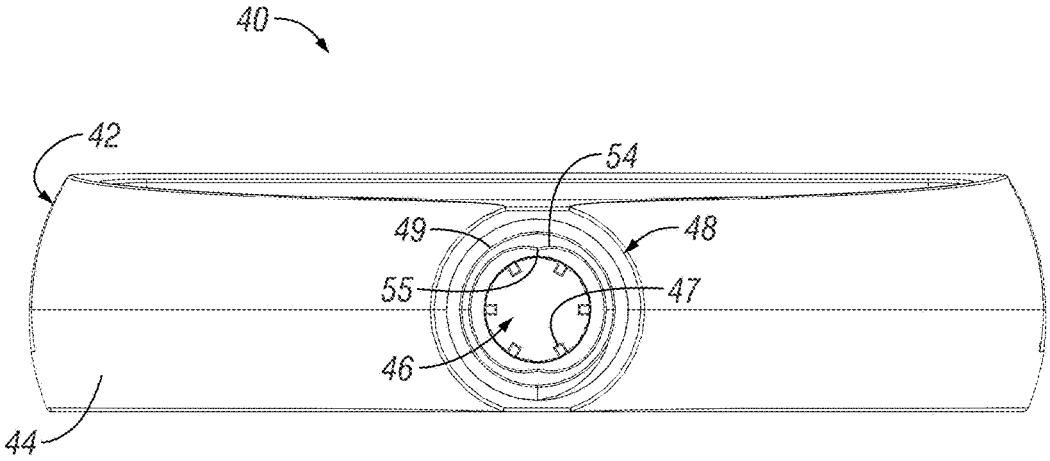
FIG. 8 is a top view of the floor care tool of FIG. 7.

Furthermore, as shown in FIG. 8, the second connection point 48 includes an aperture 54, which may be a non-uniform, keyed aperture that includes one or more protrusions 55 radially positioned within the aperture. The one or more protrusions 55 is designed to align with the one or more detents of the keyed locking collar 24 positioned on the handle 12. Therefore, the handle can be configured via the detent and protrusions of the second connection point 48 of the floor care tool to provide a predetermined alignment and/or orientation of the handle relative to the floor care tool 40. Furthermore, the detents and protrusions 55 of the aperture 54 can be configured such that the angle of the handle 12 relative to the floor care tool 40 can be varied. For example, changes the number of detents and/or protrusions around the circumference of the handle allows the handle to change such that the angle of the handle relative to the floor care tool head can be varied, which can provide for more variability for use of the tool assembly 10. The keyed locking collar 24 can also be selectably rotatable, such as by use of gears and notches to provide additional variation of rotation and/or orientation of the handle relative to the floor care tool 40. For example, the keys could be configured such that variations in alignment/orientation are available. The keys and handle could be designed to allow for additional, preset alignments, which could change the angle of the handle relative to the tool head. The presets could be a little as 5-10 degree intervals, or could be 30, 45, or 90 degree locations, wherein the degrees of rotation amount to a separate orientation between the handle and the tool head.

Therefore, the first and second connection points 46, 48, including the use of the keyed locking collar 24 and locking cap 30 of the handle 12 will provide for a more durable connection between the handle 12 and the floor care tool 40 attached thereto. The proper alignment of the keyed collar can be advantageous to provide for a predetermined orientation and/or alignment of the handle. The collar can also be used to ensure that the proper sized handle is utilized with a particular floor care tool head. For example, different sized handles may be better used with certain floor care tool heads, such as to provide greater rigidity and/or durability. To make sure that the right handle is used with the head, the keyed locking collar and/or aperture in the floor care tool at the second connection point 48 can be sized differently to make sure that the correct or desired handle is to be used with particular floor care tools. However, in the alternative, it is contemplated that a single handle 12 be universal with the aspects of the invention such that the handle 12 can be used with any and/or all of the floor care tools as will be shown and described.

Figure 7:
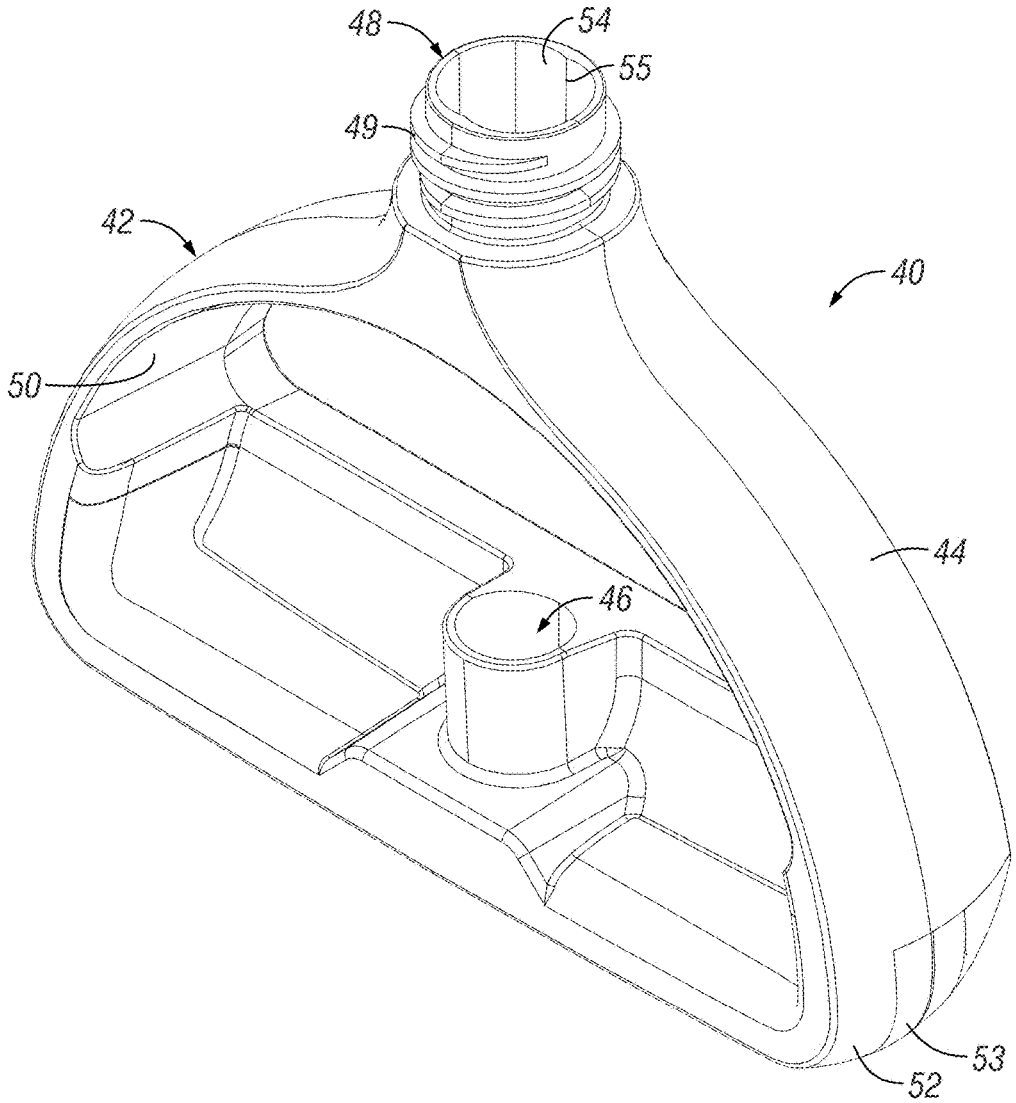
FIG. 7 is a perspective view of a floor care tool for use with the universal handle according to aspects of the invention.
Figure 9:
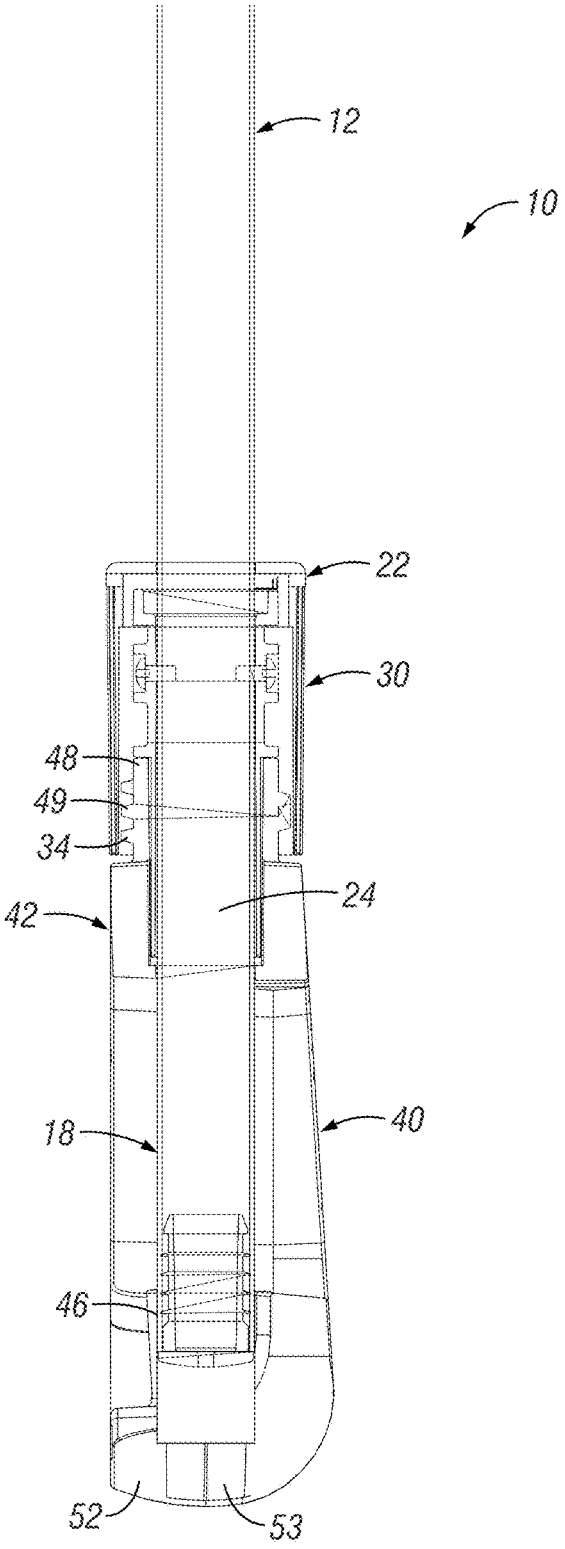
FIG. 9 is a sectional view of the floor care tool of FIG. 7 attached to a universal handle.

As shown, the floor care tool 40 in FIGS. 7-9 is shown to be a deck brush tool head. The deck brush is shaped and can be utilized with a variety of different bristles rather than just a deck brush. For example, it is contemplated that the tool head body 44 include an engaging member attachment 52 for attaching to an engaging member 53 (bristled member). The engaging member attachment 52 can include a slotted portion for receiving a slotted engaging member 53. The engaging member 53 therefore can be slid into and out of engagement with an engaging member attachment 52 of the tool head 42. For example, the engaging member 53 can be different types of bristles, brushes, or other floor care tool members. The engaging members can also include variations of similar floor care tool bristles. For example, it is contemplated that all varieties of floor care tool bristles or bristle heads being able to slide in and out of the A-frame shaped tool head body 44. However, in some embodiments, different tool head bodies will be particularly designed for particular tool head engaging members, such as a mop head frame and mop head engaging member. In either case, it is to be appreciated that the engaging member can be attached to the tool body 44 in many ways, including, but not limited to, slots, screws, adhesives, mechanical fasteners, snaps, friction, pins, or the like.

Other embodiments contemplate that the tool head be dedicated such that bristles are more permanently attached to the tool head, and are not attached via a slotted member. For example many floor care tools include tool heads that have bristles extending from bottom portion that is part of the tool head. The bristles can extend through apertures in the bottom portion, such as the portion referred to as reference 53 in the figures. The bristles can be stapled to an interior portion of the tool head and extend outward therefrom.

When the common tool head body 44 is utilized, the engaging member attachment 52 can be configured to receive generally any type of engaging member and/or bristle. For example, in some embodiments a standard deck brush bristle may be slid in with the engaging member housing 53 to form a floor care tool 40 with deck brush bristles attached thereto. However, in some areas, it may be desired to have a deck brush with a few rows of bristles that are of different material and/or size to provide better cleaning of areas, such as grout lines. For example, it is contemplated that the use of 0.8 mm diameter bristles be used for the grout section, while 0.6 mm bristles be used for the rest of the brush head. The larger grout bristles can be used to clean the grout lines, while the rest of the deck brush be used as normal. When an area not including grout lines is to be cleaned with the floor care tool 40, the bristles can be slid out via the engaging member 53 and a standard set of deck brush bristles be slid therein to clean in a normal or preferred manner. This is but one example of ways in which the floor care tool assembly 10 be modular with a single tool head 42. However, as will be understood, variations to the tool head body and/or tool heads can be included and can be utilized with different types of floor care tools to form different floor care tool assemblies.

Figure 36:
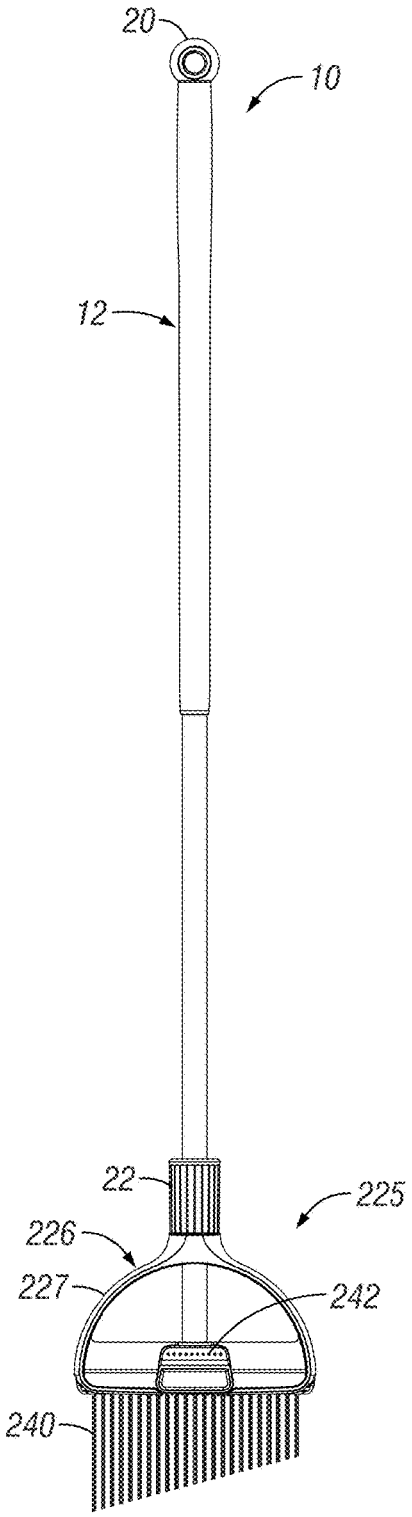
FIG. 36 is a front elevation view of another tool head assembly.
Figure 37A:
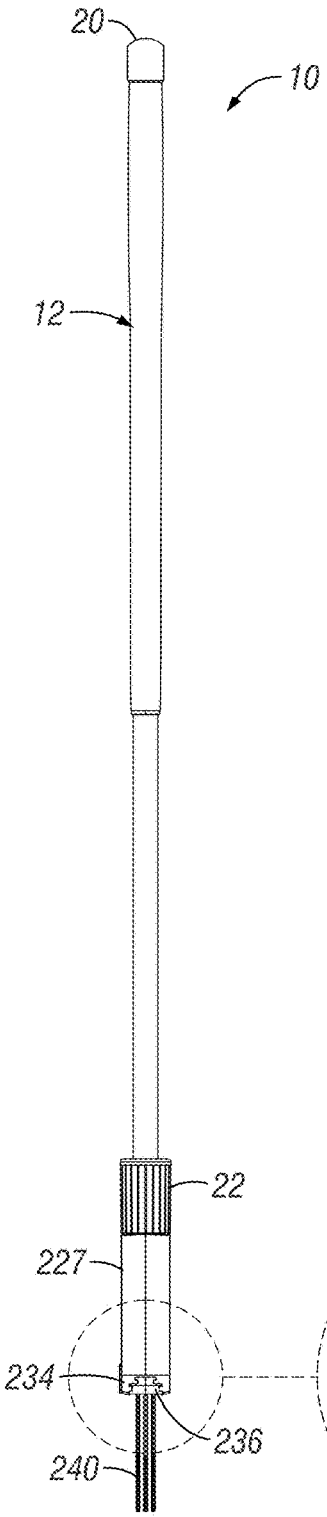
FIG. 37A is a side elevation view of the assembly of FIG. 36.
Figure 37B:
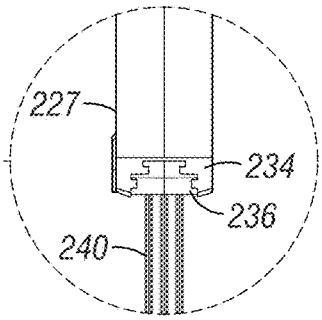
FIG. 37B is an enlarged view of a portion of the assembly of FIG. 37A.
Figure 38:
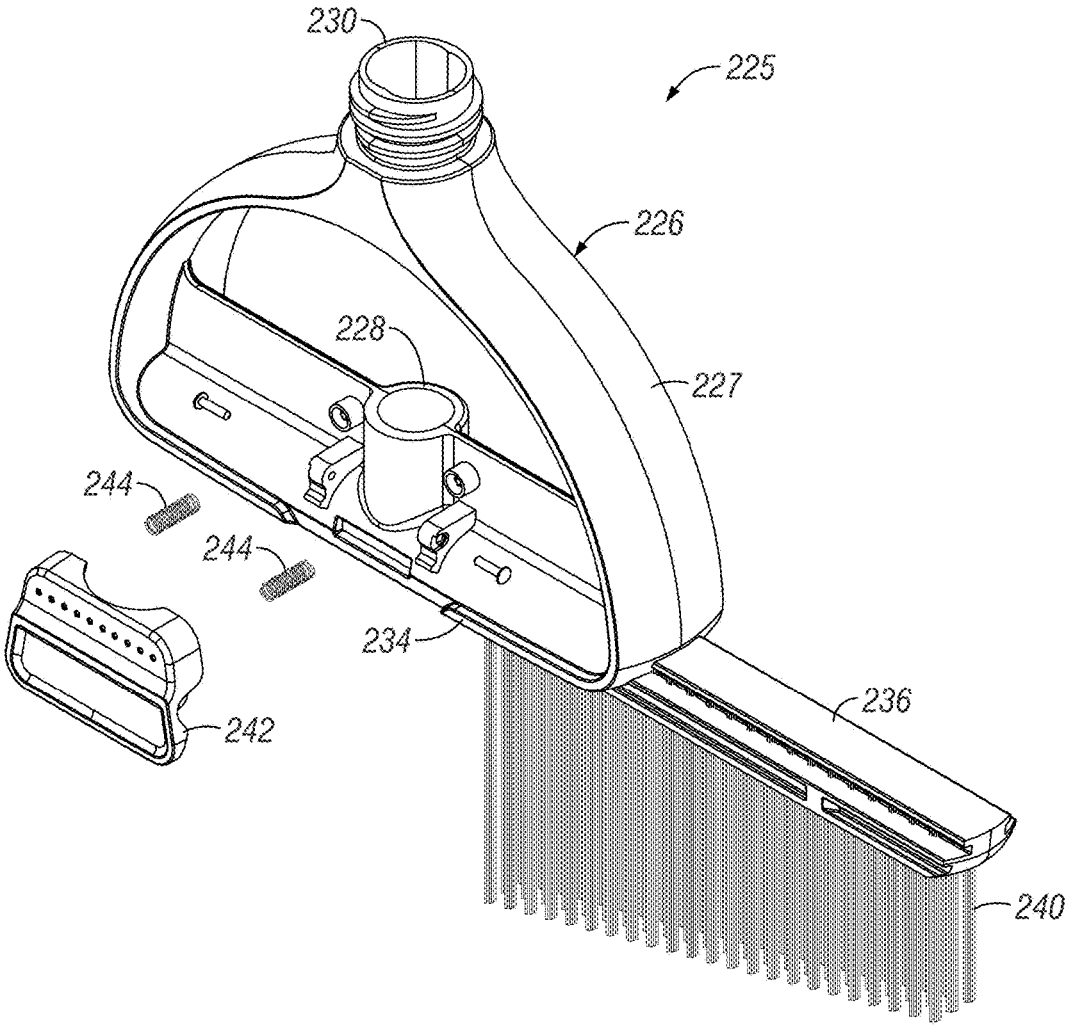
FIG. 38 is an exploded view of a tool head.

FIGS. 36-38 show a floor care tool 225 with one of the ways in which the bristles 240 can be attached to the tool head 226. As shown in the figures, the tool head 226, which is similar to the tool head 42. However, the tool head 226 includes a clamp member 242 to aid in attaching the bristles 240 to the head. FIG. 36 shows the tool 225 to be an angle broom type tool. This includes the handle 12 and components thereof. The tool head 226 also includes the connections points 228, 230 for attaching the handle 12 to the tool head 226. These can also include the keyed connection, as has been previously described. However, the figures show the engaging member attachment 234 and engaging member 236 in more detail and with the bristles 240 attached thereto.

Figure 39:
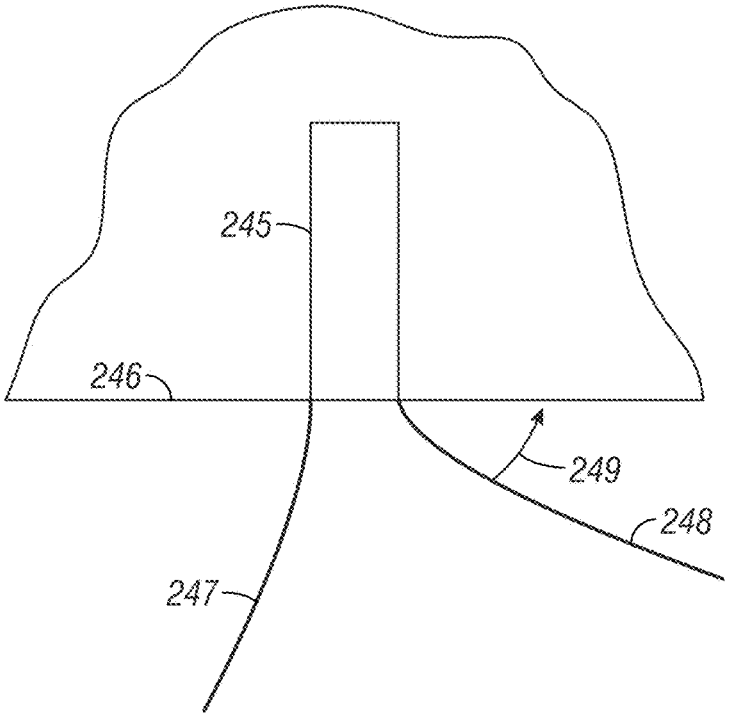
FIG. 39 is a view of a prior art attachment of a bristle to a tool head.
Figure 40:
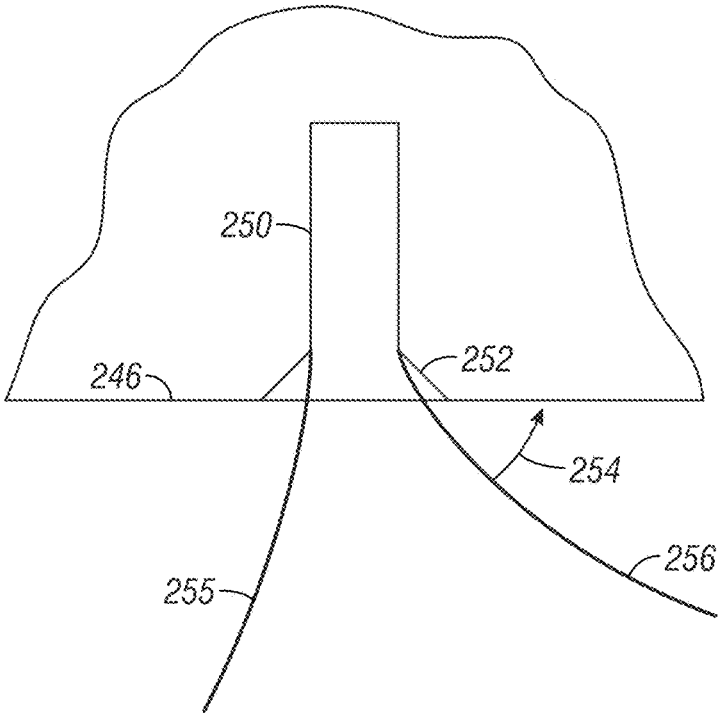
FIG. 40 is a view of a bristle attachment according to aspects of the invention.

As shown in FIGS. 37A and 37B, the tool head 226 includes a notched portion, which may be known as the engaging member attachment 234. This has been described as being one way in which bristles can be attached to the various tool heads of the invention, in which an engaging member 236 with bristles, mops, or other cleaning members can be attached to perform the cleaning with the tool. In the figures, the bristles 240 are shown to be in the form of an angle broom. The bristles 240 can be attached to the engaging member 236 in any way known in the art, such as by extending through apertures and stapling the bristles to the engaging member 236. One standard way of attaching the bristles is shown in FIG. 39, where the bristles, 247, 248 are attached at a cutout 245 of a tool head 246. When the bristle 248 is moved in the direction of the arrow 249, it can become crimped due to the right angle of the cutout 245 relative to the tool head 246. Therefore, the invention contemplates having a cutout 250 such as that shown in FIG. 40. It is contemplated that the apertures 250 of the engaging member that the bristles 255, 256 extend through can be chamfered or otherwise countersunk, such as that shown by reference numeral 252 in FIG. 40, such that the apertures have a larger radius at the bottom than at the top. This chamfer or radius would relieve some of the stress when you bend the bristle 256 over in the direction of the arrow 254 and maybe not be kinked as easily compared to the sharp corner that is there now. The mitigation of crinkling or kinking of the bristles would extend the life of the bristles, and thus, the life of the tool itself. The engaging member 236 can be slid in the notched portion of the engaging member attachment portion 234 of the tool head body 227. This is shown best in FIG. 38, where the engaging member 236 is partially inserted in the notch. A clamp 242 on the tool head 226 includes springs 244. The clamp 242 is engaged to allow for the insertion of the engaging member 236, and when the member 236 is in place, the clamp 242 can be released to aid in holding the engaging member 236 in place relative to the tool head 226. Other members, such as latches, pins, or the like could also be used to aid in holding the engaging member in place.

It should be appreciated that the countersinking/chamfering of the holes through which the bristles extend could be used with any type of bristles, as well as with any tool, and not just the case in which the engaging member is slid through a notch of the tool head. For example, in embodiments, such as those shown in FIGS. 1-9, where the tool head is a single component with bristles extending out a bottom portion thereof, the apertures through which the bristles extend could also be chamfered and/or countersunk such that the radius would mitigate kinking of the bristles.

Figure 10:
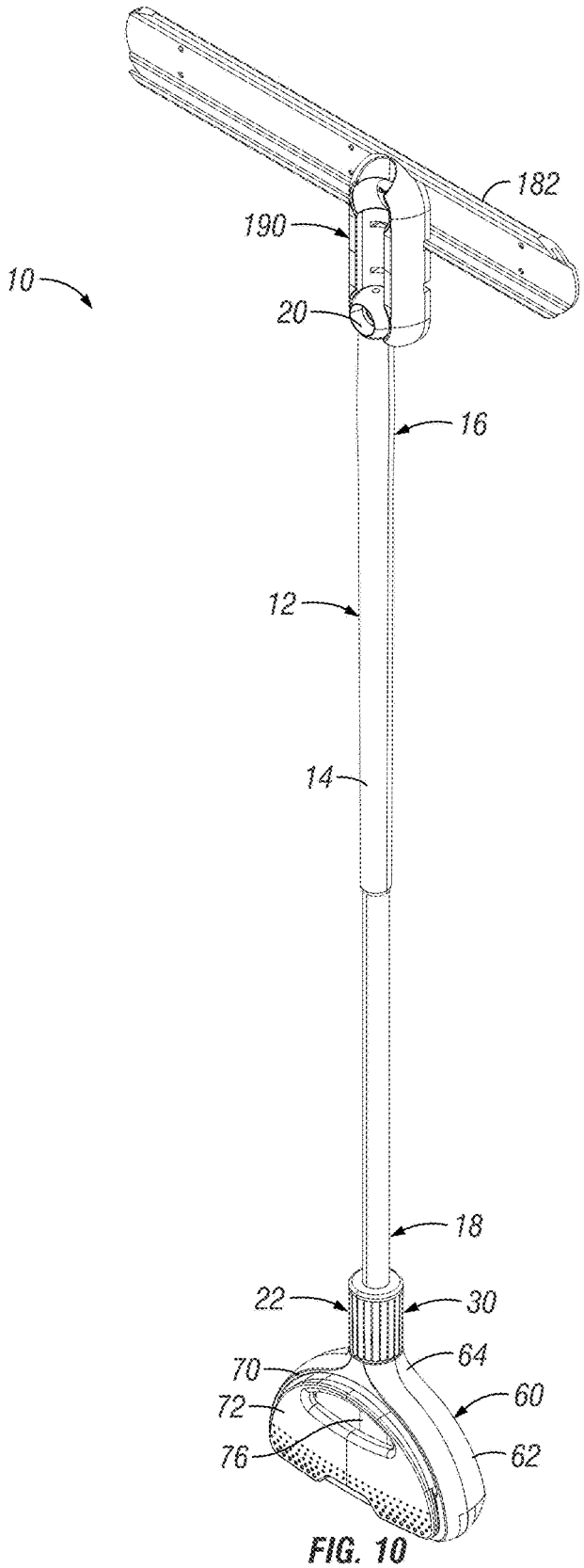
FIG. 10 is a perspective view of another tool assembly mounted to a mounting and/or storage system.
Figure 11:
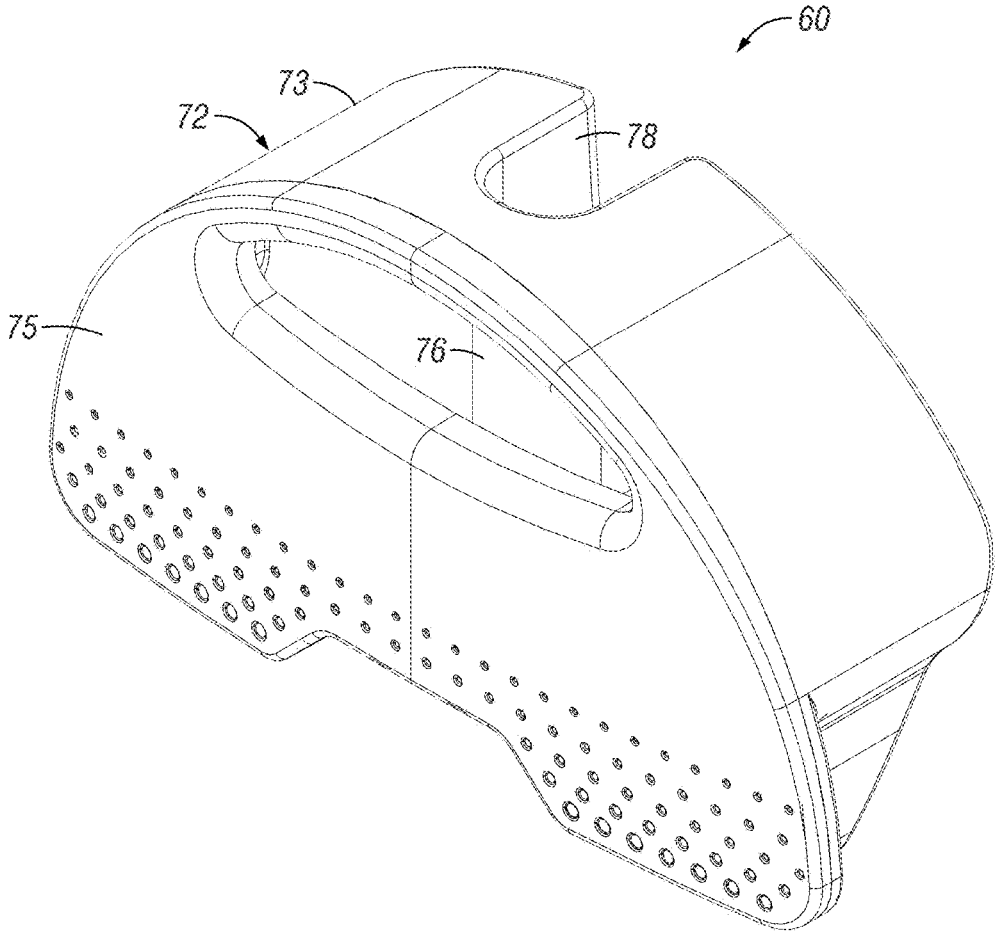
FIG. 11 is a perspective view of a tool head insert or attachment for use with a tool head.
Figure 12:
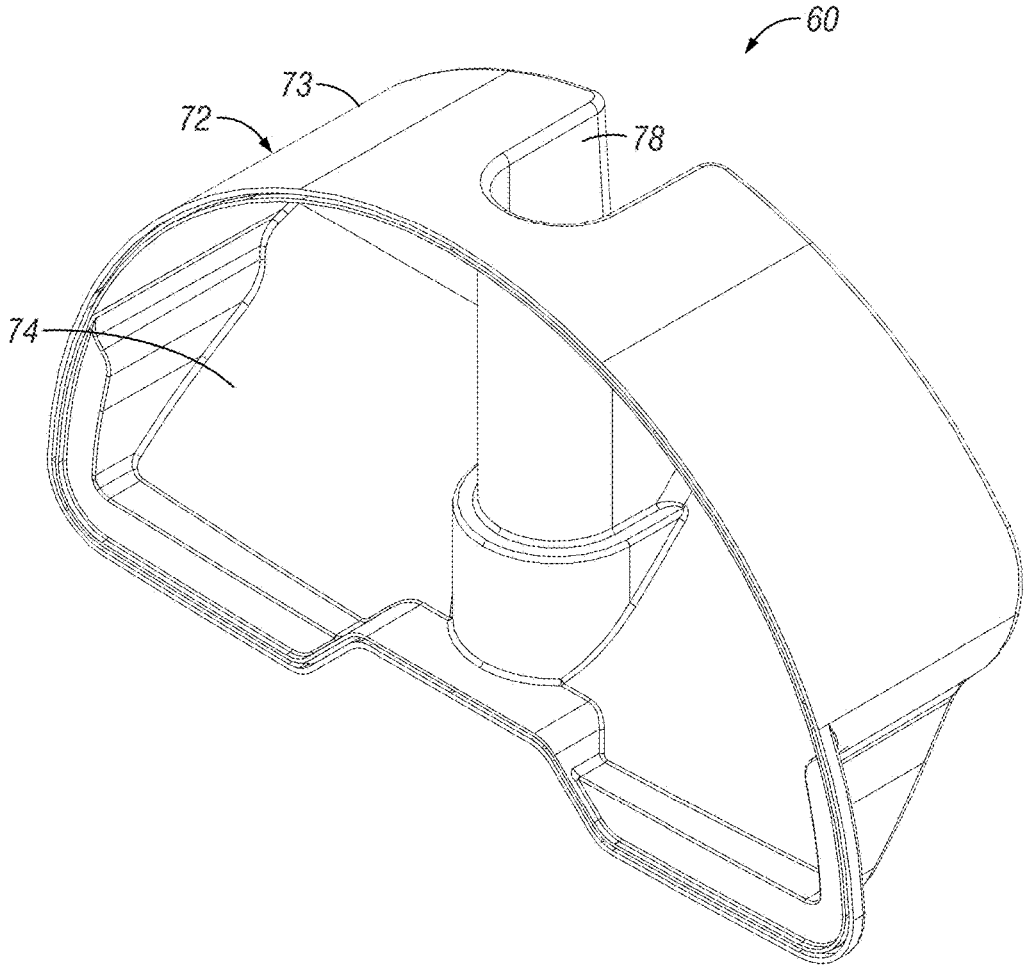
FIG. 12 is a view of the tool head insert of FIG. 11 with components removed.
Figure 13:
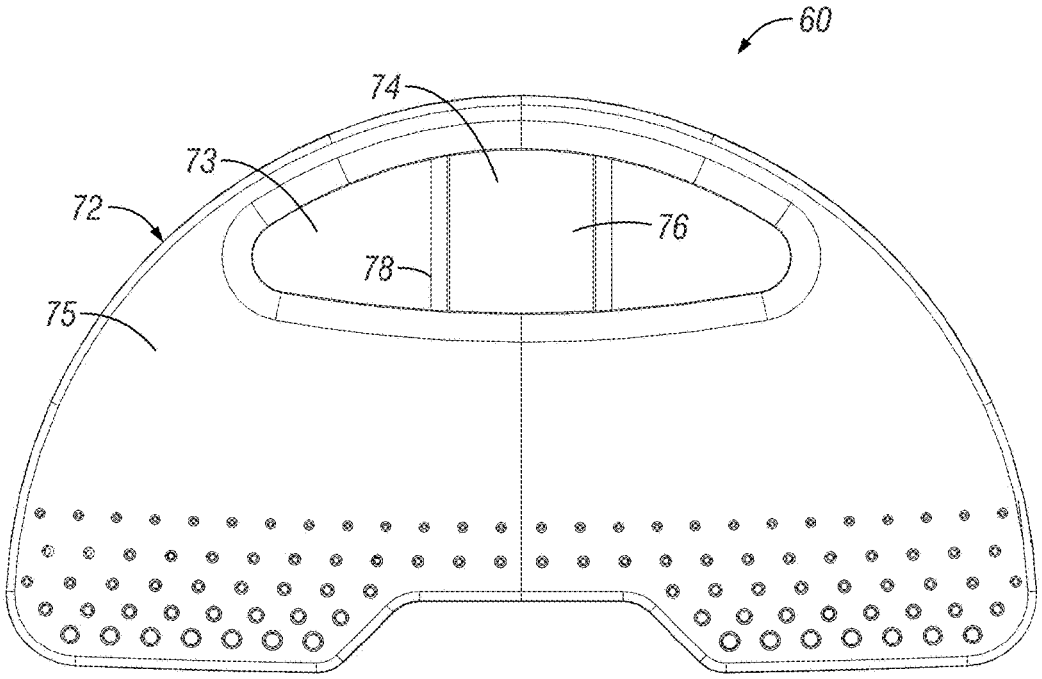
FIG. 13 is a front view of the tool insert of FIG. 11.
Figure 14:
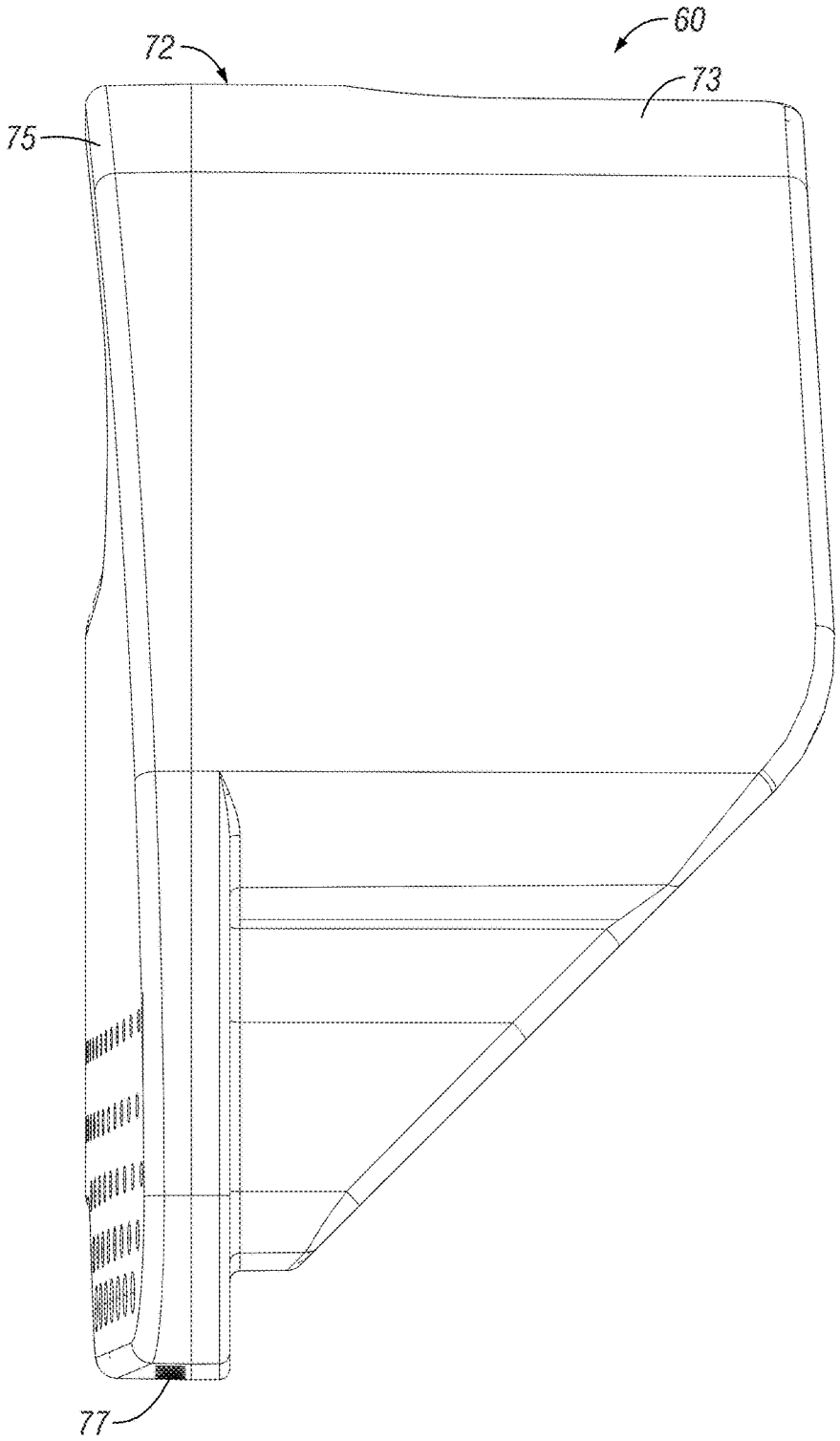
FIG. 14 is a side elevation view of the tool insert of FIG. 11.
Figure 15:
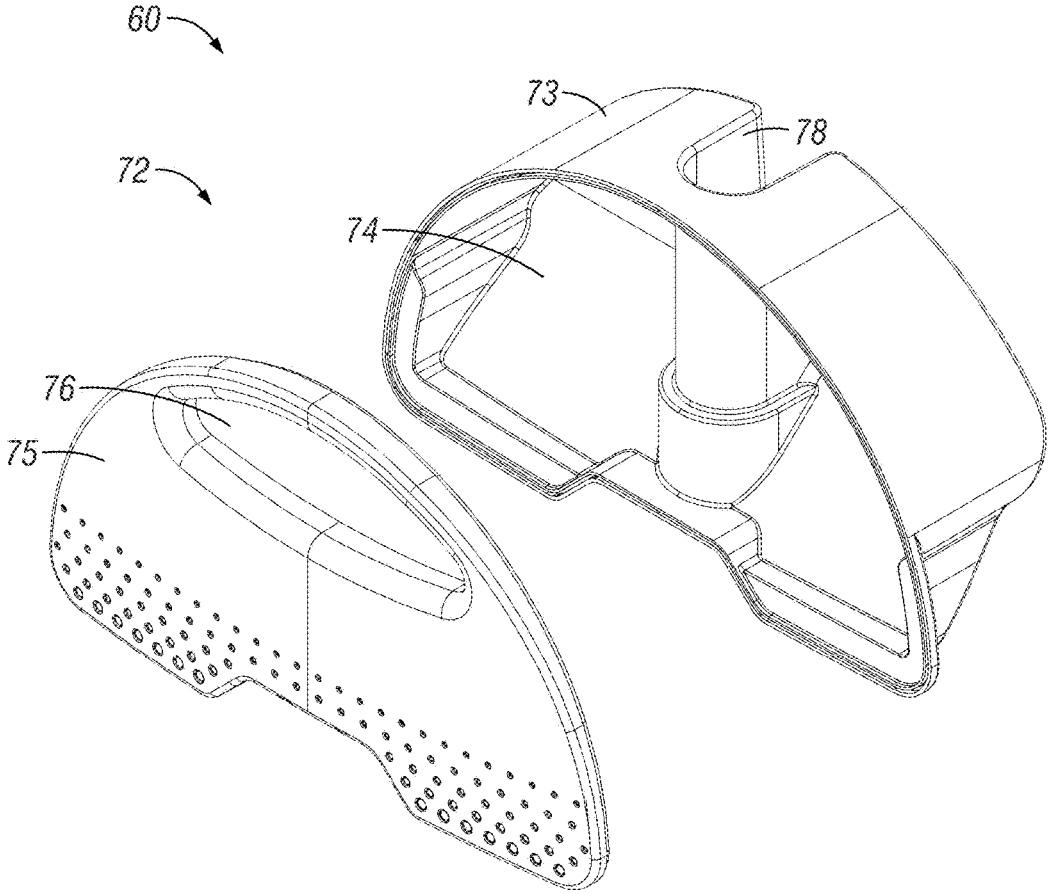
FIG. 15 is an exploded view of the tool insert of FIG. 11.

FIG. 10 is a perspective view of a floor care tool assembly 10 accordingly to additional aspects of the invention. The floor care tool assembly 10 shown in FIG. 10 includes the handle 12 as has been previously shown and described. Additional aspects shown in FIG. 10 include the tool assembly 10 connected to and/or mounted to a mounting assembly 180, which is shown in greater detail in FIGS. 31 and 32. The mounting assembly 180 includes a channeled rail 182, which can be attached to a wall or other surface, such as via screws, adhesives, or the like. The rail 182 can be permanently or temporarily attached to a wall or other structure. A puck member 190 is attachable to the rail 182. The rail 182 includes channels extending upward and downwardly from upper and lower portions of the rail 182. The puck 190 includes notches in a back side thereof to slide said puck 190 relative to the portions of the rail 182. It is noted that the number of notches found on the puck 190 allows it to be positioned in different manners, such as with the puck extending below the rail 182 as shown in FIG. 10, the puck being medially positioned on the rail 182, or the puck being positioned generally above the rail system. Furthermore, the puck 190 includes receiving pockets for receiving a portion of the mounting member 20 of the handle 12, such as in a ball and socket manner. As shown in FIG. 10, the mounting member can be fit into a receiving portion of the puck 190 to hold the tool assembly 10 in place for mounting and storage. While the mounting member 20 is shown to be stored in a lower portion of the puck 190, it is also to be appreciated that the mounting member can be configured to snap generally anywhere along the height of the puck member 190 and can include preset receiving portions, such as at the upper portion, lower portion, and middle portion of the puck 190. Furthermore, it is to be appreciated that while the puck 190 and mounting member 20 are shown to be generally spherical members for receiving and storing, generally any corresponding shape between the handle 12 and the puck 190 can be utilized and are to be considered part of the invention for storing, mounting, and other purposes.

In addition, a different floor care tool 60 is shown to be attached to the handle 12 to form the tool assembly 10 in FIG. 10. The floor care tool 60 includes a tool head 62 having a tool head body 64. The tool head body is generally of the A-frame shape, similarly to that shown previously. Therefore, the same tool head body may be utilized for the configuration shown in FIG. 10. In addition, similar connection points, such as a first connection point 46 and second connection point 48 are included with the tool head 62 for attaching to the handle 12 at first and second points to mitigate rotation of the handle relative to the tool head 62. The connection points will be similar in terms of internal threads 47, external threads 49, and a keyed aperture in the second connection point 48 to correspond with the keyed locking collar 24 of the handle 12.

Due to the nature of the A-frame shape, including the bottom portion and arched walls of the tool head 62, the tool head 62 will include a generally hollow internal section 70. This can also be found in the tool head 42, which was previously shown and described. Shown in FIG. 10 and inserted within this internal section 70 of the tool head body 64 is a floor care insert and/or attachment 72. The insert or attachment 72 can be one of a plurality of attachments that are designed to fit within the internal section of the tool head body 64 and which can be easily inserted and secured thereto and thereat. For example, in FIGS. 10-15, the insert 72 is shown to be a mop bucket style insert for use with a deck brush scoop. However, other inserts, such as weighted inserts or the like can be provided. For example, a weighted insert can be used with a deck brush tool head frame to provide added weight to the brush for easier and more effective scrubbing. This would reduce the amount of force required by the user, which will aid in operation of the floor care tools.

As mentioned, the insert 72 shown in FIGS. 10-15 includes a scoop style insert for use with a deck brush bristles or other mop bristles. The scoop member 72 provides a way to scoop a liquid, such as a liquid solution, from a mop bucket or other vessel and to distribute the liquid product on the floor or other surface being cleaned. As some cleaning solutions must be applied to the floor before scrubbing, the insert 72 provides a controlled manner of application. For example, previous ways of applying the solution include simply dumping and/or pouring solution on the floor, and then brushing or mopping it to clean said floor. The scoop insert 72 provides a way to control the application of the liquid product as the floor is being cleaned with the brush and to limit the amount of area in which the solution is applied during a certain amount of time. The scoop insert 72 is designed to be used with a bucket or other vessel containing the cleaning solution or other liquid (e.g., water), wherein the scoop is able to receive an amount of the solution when inserted in the vessel to temporarily store an amount of solution. The solution is then allowed to leak or otherwise emit from the scoop insert 72 onto the floor surface wherein a user is able to mop, scrub, or otherwise apply the solution.

The scoop 72 includes a body portion 73 and a cover 75. The body portion 73 is a generally hollow member forming a reservoir 74 for receiving and storing an amount of cleaning liquid. The cover portion 75 is configured to align with an opening of the body portion 73 to provide a cover for the reservoir 74 and to provide for filling and releasing of the cleaning liquid. For example, as shown in the figures, the cover 75 includes an upper main aperture 76, and a plurality of release apertures 77. The release apertures are formed by creating holes through a bottom portion of one of the body or cover portions of the scoop insert 72. For example, a portion of the cover may be cut away such that, when joined with the body portion 73, holes exist at the seam between the two. Liquid that is stored in the reservoir passes through these holes and onto the floor being cleaned.

The additional circles on the front of the cover 75 may be decorative or functional. For example, the circles may be simply indents of the cover. In some embodiments, the circles may be apertures through the cover through which additional liquid is able to pass onto the floor.

When the cover and body 75, 73 are attached to one another, the floor care tool 60 can be inserted into a bucket containing cleaning solution. The cleaning solution is allowed to enter the reservoir 74 of the body 73 via the main aperture 76. The solution will then be stored in the reservoir 74. When removed from the bucket, the solution will begin to leak or otherwise be dispensed from the insert 72 via the release apertures 77 along the bottom of the insert and tool care head. These can be sized and positioned such that a desired amount of solution is dispensed from the insert during the cleaning process with the floor care tool 60. Once the solution in the insert 72 has been fully dispensed, the process can be repeated with the floor care tool and insert being inserted into a bucket to receive an additional amount of liquid.

As mentioned, the insert can be used with a tool head, such as an A-frame shaped tool head as has been shown and described. Similarly, the tool head will include a section, which may be a slidable engaging member attachment, wherein an engaging member 53 can be inserted and connected to the body 64 to add bristles or other cleaning surfaces to the floor care tool 60. The dispensed solution via the apertures 77 will then work with the bristles or cleaning member engaged with the frame body to provide a cleaning tool.

Furthermore, as has been disclosed, the insert 72 can be used with the A-frame shaped tool body 64. Thus, the insert body 73 includes a handle engaging connection 78 that is shaped to surround at least a portion of the handle 12 and the first connection point 66 of the floor care tool 60. The insert can be snap fit, friction fit, or otherwise engaged with the floor care tool head 62 to hold the insert within the inner space 70 of the tool head body 64. In addition, the size and shape of the insert 72 can be varied as the size and shape of the tool head 62 and body 64 are varied.

As has been mentioned, additional inserts other than a scoop member can be included with a tool frame and art to be included as part of the invention. For example, a weighted insert can be installed wherein a solid or other weighted member is positioned in the interior portion of the tool head body. Furthermore, color coding members can be included to distinguish various tool heads and/or bristles for use with the handle of the invention.

In addition, other inserts, such as colored or use-signifying inserts can be utilized with the invention. As the tools can be used in commercial environments, it may be desired to use only certain tools in certain areas of the commercial environment. For example, in a restaurant, a cleaning tool used in a restroom may not be intended to be used in a kitchen at a later time. In addition, different locations of the kitchen may include different bacteria, wherein it is desirable to mitigate the possibility of cross contamination of aspects in the environment. Therefore, colored inserts may be included with the interior portion 70 of the tool head body 64 enabled to indicate the desired use location for particular floor care tools. For example, a certain color can indicate that the floor care tool assembly 10 is only utilized in a kitchen environment, while a different color indicates that a tool is only to be used in an eating portion of the restaurant, such as a dining area. This will aid in mitigating the chance of cross contamination between the two separate environments. Different inserts or types of inserts for indicating use are contemplated. For example, according to some aspects of the invention, a plate inside the A-frame and secured by a portion of the elongated shaft of the handle 12 can be utilized wherein the color of the plate signifies the intended use and/or location of the use for the particular floor care tool assembly. Additional types of inserts may include a frame inside the A-frame and includes apertures for receiving a portion or portions of the handle 12 to indicate use location. Additionally, a picture or icon could be included with the frame to identify the location of use, type of use, or the like. In addition, a shield on the A-frame can be included wherein the shield is supported by a portion of the handle at or near the connection points. The shield can include pictures for intent of use, location of use, or some combination thereof wherein pictures are included on the shield and in addition to a particular color thereof. Still further, a colored sleeve can be positioned on a portion of the handle, such as by sliding, snapping, or otherwise at least partially surrounding the handle to designate an intended use for the tool. For example, a colored sleeve could be sized to be approximate or less than the length of the handle between the two connection points. The sleeve could be a con-connected cylinder that is able to be opened to surround the handle portion. Therefore, the colored sleeve could be quickly attached upon designation of the tool for a particular use, and could be changed, if needed.

The inserts and or attachments could also be non-cleaning or otherwise. This could include a liquid wax for waxing a floor, paint for a roller, etc. In such instances, the insert could include an amount of material that is dispersed on a surface in interaction with the tool to apply said material on or about the surface. For example, paint could be included and dispersed out an insert or attachment and onto a surface. A painting brush, such as a roller brush, could be attached to the handle and be used to apply the dispersed paint onto the surface without having to replenish the brush head constantly with more paint material.

Still other types of inserts are contemplated to be included and could include additional or separate types of cleaning solutions, wherein a first cleaning solution is applied and then a second solution released from the insert. Furthermore, a fan could be included with the insert to aid in drying an environment as it has been cleaned by a liquid solution or product.

Figure 16:
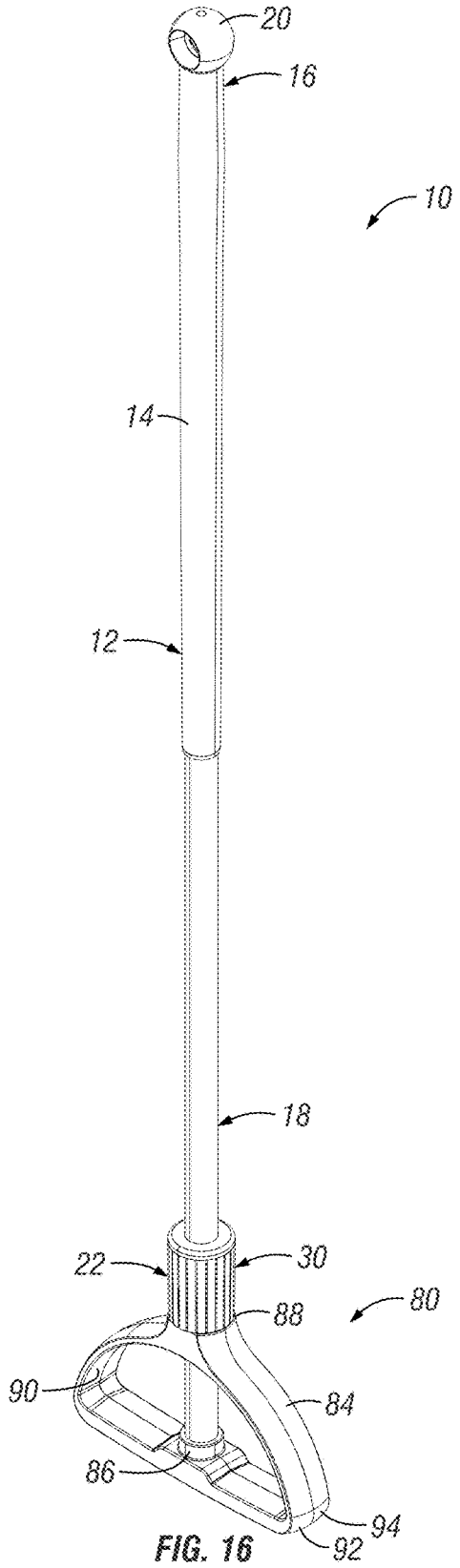
FIG. 16 is a perspective view of another tool assembly.
Figure 17:
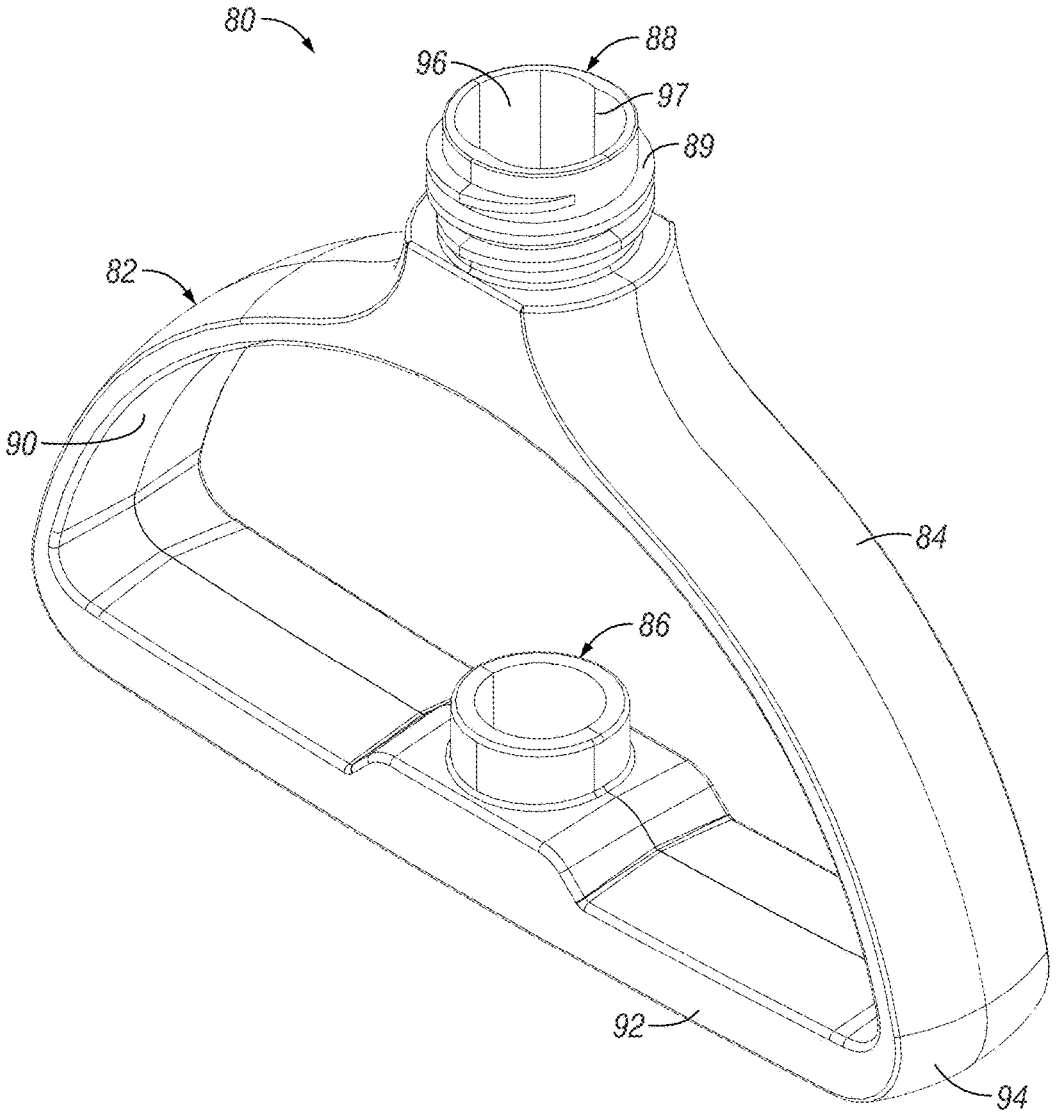
FIG. 17 is a perspective view of a tool head for use with a universal handle according to aspects of the invention.

FIG. 16 shows yet another floor care tool assembly 10 wherein a floor care tool 80 is attached via first and second connection points 86, 88 to the handle 12 as has been shown and described. The floor care tool 80 is shown in greater detail in FIG. 17. The floor care tool 80 includes a tool head 82 with a body 84. The body 84 is shown generally shaped in the A-frame shaped, as has been shown and described. However, it is to be appreciated that the bottom portion of the body 84 is wider such that the arches are not as steep as in previous depictions. The greater width of the body 84 can allow for different types of bristles, brushes, mops, or brooms to be included or used with the tool 80. Similar aspects of the floor care tool 80 include a first connection point 86 and a second connection point 88. The second connection point 88 will include external threads 89 for connection with the locking cap 30 of the handle 12. The first connection point 86 can include internal features, such as threads, for providing the additional connection between the handle and the tool head 82. Furthermore, the second connection point 88 includes a keyed aperture 96 including one or more extrusion or protrusions 97 which align with the detents of keyed locking collar 24 of the handle 12 to aid in alignment and/or orientation of the handle 12 relative to the tool head 82.

The frame of the tool head body 84 may be ideal for use with angled brooms, wherein the length of the bristles of the broom decrease from one side to the other. However, the frame can be used with any of the other uses shown and described in the invention, and is not to be limited to a particular type of brush, broom, or the like. Furthermore, the bottom portion of the tool head 82 includes an engaging member attachment 92 for use with an engaging member 94. As mentioned, the engaging member attachment 92 may be a slot or other connecting components in which an engaging member 94 which can include bristles extending therefrom, to attach to the tool frame 82 at the attachment location 92. For example, when the attachment is a slot member, the engaging member can be slid from either side of the tool head body 84 such that the bristles will become attached to the tool head 82. However, other types of attachment means, including but not limited to, snaps, clamps, magnets, screws, adhesives, friction fit, or the like are included as part of the invention to allow for a permanent or removable connection between the bristle engaging member and the tool head body 84 to provide for use of the floor care tool assembly 10.

Figure 18:
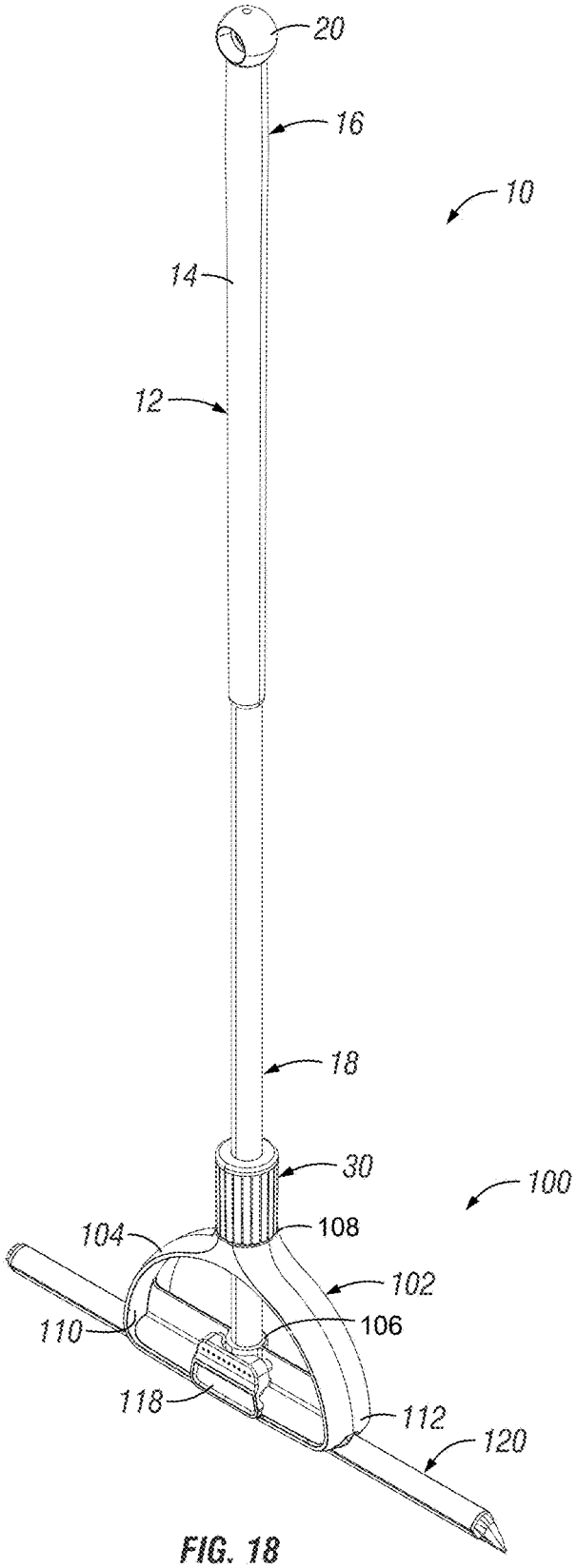
FIG. 18 is a perspective view of another tool assembly.

FIG. 18 shows yet another tool assembly 10 in which a floor car tool 100 is attached to a handle 12 that has been previously shown and described. The floor care tool 100 attached to the handle 12 in FIG. 18 is of the standard A-frame shape and configuration. However, as is understood, the tool 100 provides for additional components to easily attach and/or release an engaging member 114. For example, some engaging members, such as squeegees, need replaced more often than other bristles, brooms, mops, or the like. This is mainly due to the nature of use of squeegees. The quick release of the tool head 102 provides for a quick and easy release of the squeegee such that it can be replaced with a new component.

Figure 19:
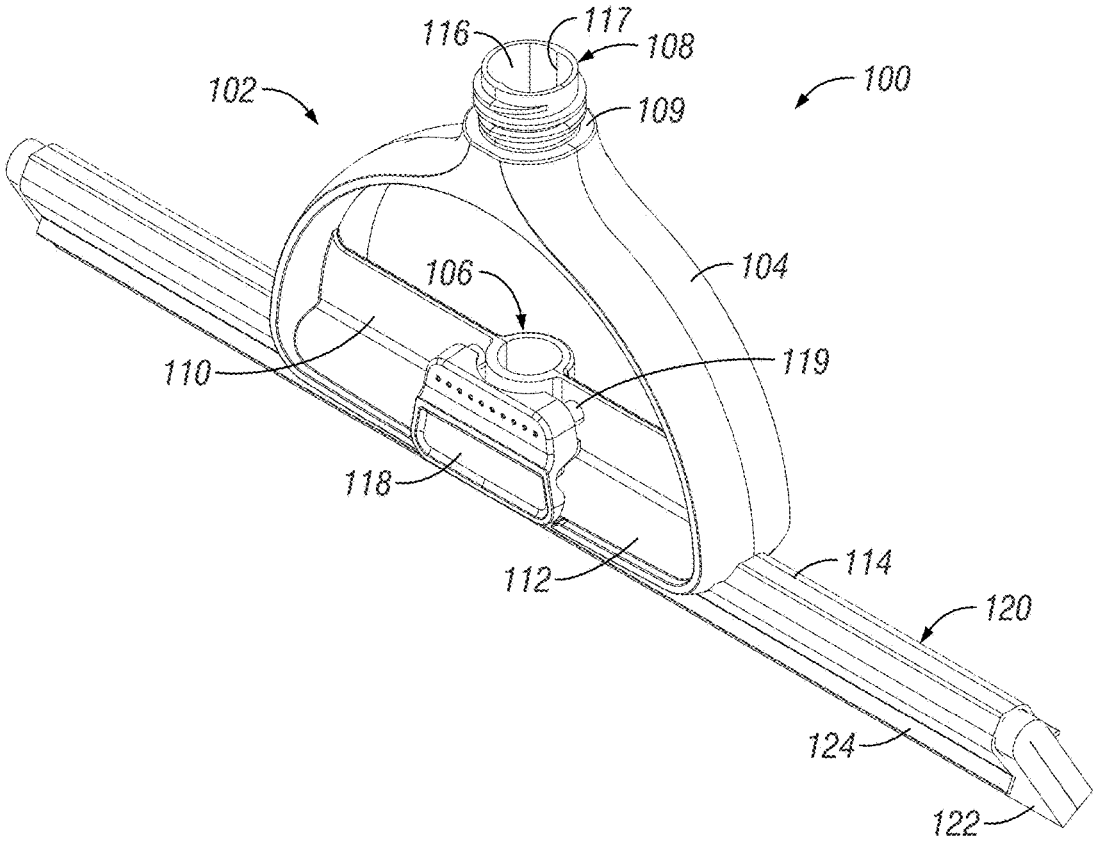
FIG. 19 is a perspective view of a tool head assembly for use with a universal handle according to aspects of the invention.
Figure 20:
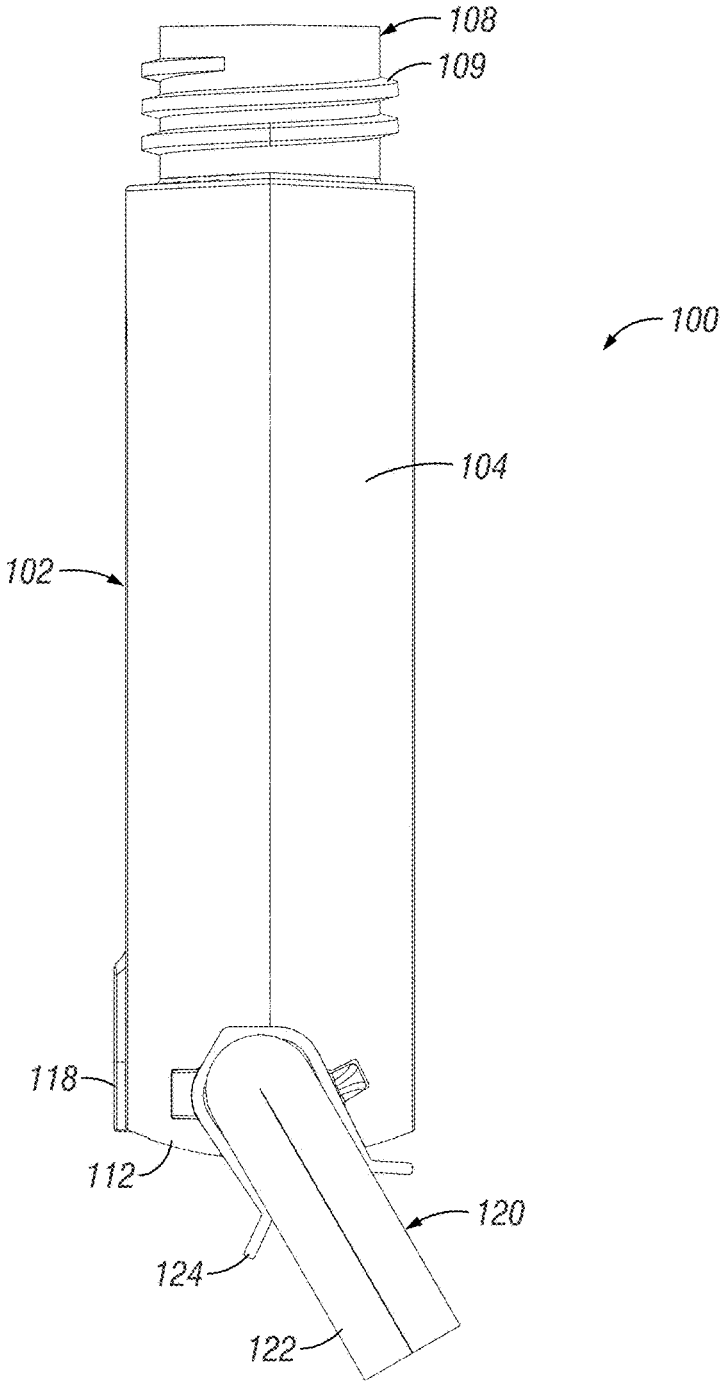
FIG. 20 is a side elevation view of the tool head assembly of FIG. 19.
Figure 21:
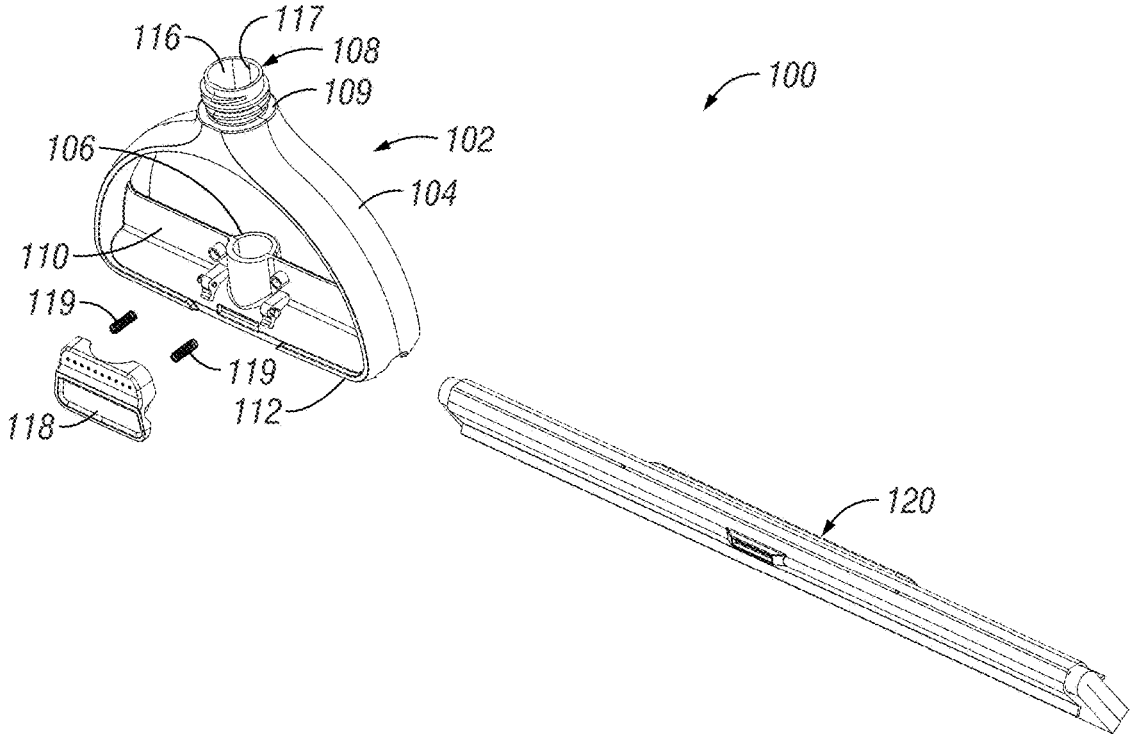
FIG. 21 is an exploded view of the tool head assembly of FIG. 19.

As shown in FIGS. 19-21, the floor care tool 100 includes a tool head 102 comprising a tool head body 104. The tool head body includes a bottom member with arched side portions extending and meeting at an upper portion. The bottom portion of the body 104 includes a first connection point 106 wherein the first connection point includes threads, snaps, or other methods for attaching to a portion of the handle 12. The upper portion of the body 104 includes a second connection point 108 including threads 109 and a keyed receiving aperture 116 for engaging a keyed locking collar 24 and locking cap 30 of the handle. Therefore, the body 104 includes the same dual connection components as has previously been shown and described. Furthermore, the inner section 110 of the body 104 includes a ridge with a clamp 118 connected thereto. The clamp is movable, i.e., rotatable, relative to the body 104 via springs 119. The springs 119 allow the bottom portion of the clamp to be moved to and from a portion of the tool body 104. The clamp 118 works with the engaging member attachment 112 at a lower portion of the tool head 102 to engage and disengage an engaging member 114. For example, shown in FIGS. 19-21, the engaging member 114 is a squeegee assembly 120.

Different squeegee assemblies are contemplated to be used with the floor care tool assemblies of the invention. For example, in FIG. 18, the squeegee assembly 120 comprises an overmolded rubber squeegee member 122, including a housing 124 that is overmolded a rubber squeegee component. The composition and angular configuration of the squeegee assembly allows for the squeegee to be used by pushing the tool away from a user, rather than the standard pulling of a squeegee member, as is commonly required. This is an advantage as it allows the operator to push the cleaning solution or other liquid away from the operator instead of pulling towards, which can create hazards.

Furthermore, in FIGS. 19-22, an overmolded foam or sponge style squeegee assembly is provided. The assembly 120 shown in these figures comprises a foam, moss, sponge, or other relatively absorbent material that is overmolded with a rubber or plastic housing 124 for attaching to a tool head member.

In either embodiment of the squeegee assembly as shown in the figures, it should be appreciated that the angle of the squeegee member relative to the handle 12 be varied to provide for advantages, such as those related to pushing/pulling, type of material, height variation, and other intended uses. For example, as shown best in FIG. 20, the squeegee member 122 is angled approximately 60 degrees below horizontal, or approximately 150 degrees relative the axis of the second connection point 108 of the tool head. However, it should be appreciated that other angles may be contemplated, such as angles between 15-75 degrees below the horizontal, and more preferably, between 30 and 60 degrees below the horizontal. The angle of the squeegee member relative the handle axis allows the squeegee portion of the tool head to be at or near vertical when in use, such as when the handle is angled. The angle of the members could be determined based upon average height of a user, as the user's height will be a factor in determining the angle of the handle relative the ground. Therefore, the angle of the squeegee member could be determined such that a user of average height will use the assembly such that the squeegee will be most effective (i.e., best angle between squeegee member and surface) at the angle of the handle.

Figure 22:
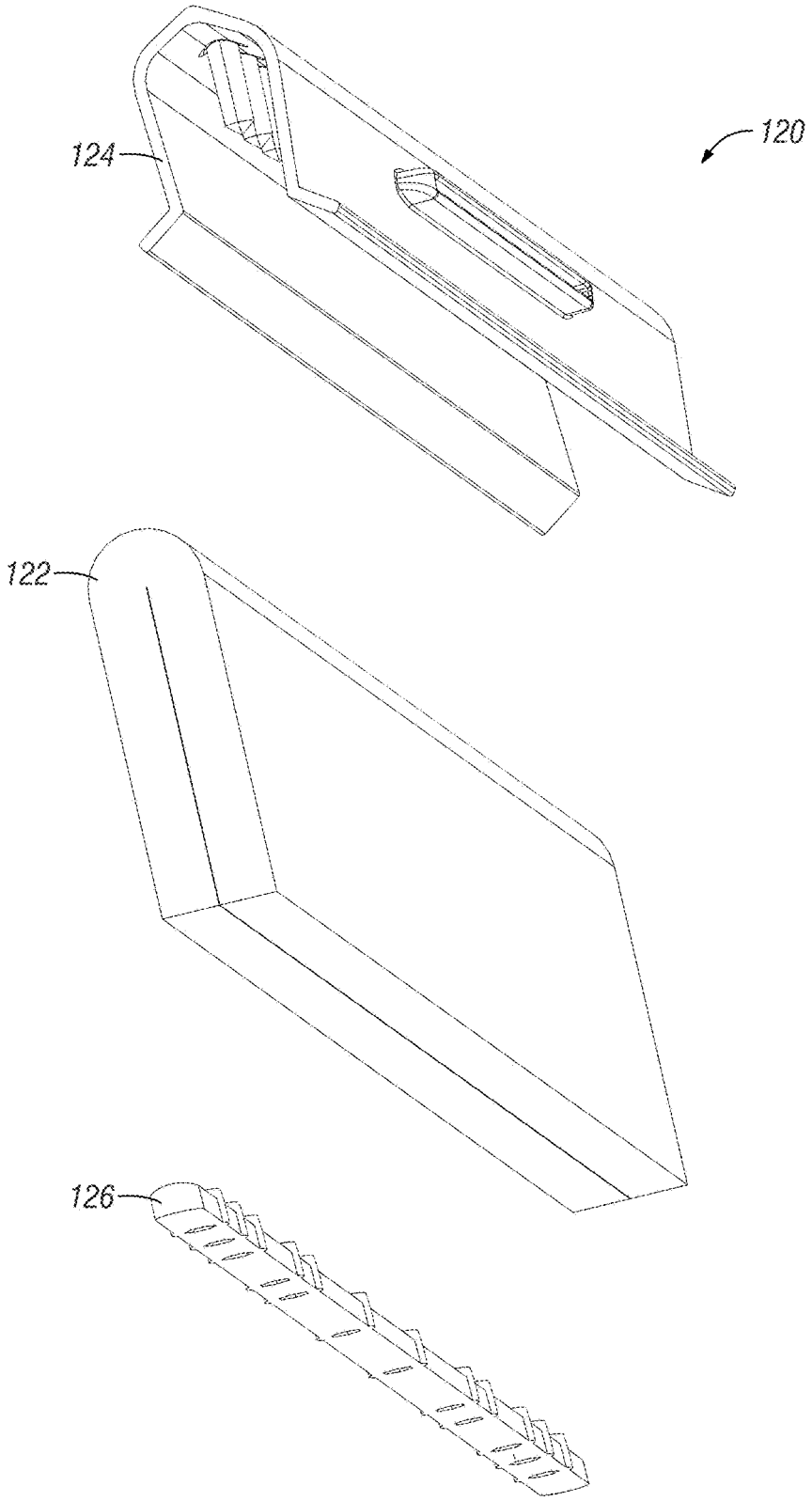
FIG. 22 is an exploded view of portions of the tool head assembly of FIG. 19.

The squeegee assembly 120 is shown in an exploded manner in FIG. 22. Components of the assembly include a squeegee refill 122, which can be a tool with a flat, smooth rubber blade or surface. It is useful for removing and/or controlling the flow of liquid on a surface. The squeegee refill 122 is housed within a squeegee housing 124. The refill 122 is held in place at the housing 124 via a locking rib 126, as is shown in FIG. 22. The exact configuration of the squeegee assembly is not to be limited to the invention, and generally any squeegee and/or refill known and used in the art are contemplated to be a part of the invention.

The engaging member attachment portion 112 of the tool body 104 can include a slotted portion in which the squeegee assembly can be insertable from either side of the head. The squeegee housing 124 can be used with the slot of the tool head engaging attachment 112 to slide the squeegee assembly 120 into place relative to the tool head 102. Once positioned, the clamp 118 can be released to clamp the tool head body 104 in place at the squeegee assembly to aid in holding the squeegee assembly in place relative to the tool head 102 of the floor car tool 100. The quick release design offers easy removal and/or changing of the squeegee and mopped items. The squeegee can be insertable from either side of the tool head and can be automatically snapped into a location. To release the squeegee assembly, the clamp must be moved to release the squeegee blades from the tool head 102. Therefore, it is contemplated that the squeegee can be slid in such a manner to be easily replaced and/or otherwise manipulated.

While the figures show the use of a clamping member 118 to aid in connecting the squeegee assembly 120 to the tool head 102, it is to be appreciated that other types of members can be used. For example, the clamping member is hingeably connected to provide the clamping source. Other types of clamping-type members, such as snaps, band clamps, c-clamps, hand screws, magnetic clamps, set screws, pins, such as clevis pins, cotter pins, snapper pins, tab-lock pins, ball lock pins and the like, keyholes, or locking devices may be included instead to aid in holding the squeegee or other attachment assembly in place with the tool heads.

Furthermore, while the figures show a squeegee head being insertable in the quick release manner, it is to be contemplated and appreciated that any type of the tool heads, including different types of bristles, brooms, brushes, mops, and the like, can be used with the quick release and/or insertable member. For example, the squeegee assembly could be replaced with a mop assembly and inserted in a manner such that the clamp will hold the mop in place instead of a squeegee assembly. The mop could then be replaced by releasing the clamp and sliding the mop member relative to the tool head. Other types of brushes can also be inserted and removed in such a manner. However, it should also be appreciated that the sliding member is not the only way to affix, either temporarily or permanently, a cleaning member to a floor care tool. For example, some floor care tools can include bristles, brushes, mops, or the like, which can be more permanently affixed, such as by screwing, adhering, or otherwise attaching the bristles to the floor care tool heads.

Figure 23:
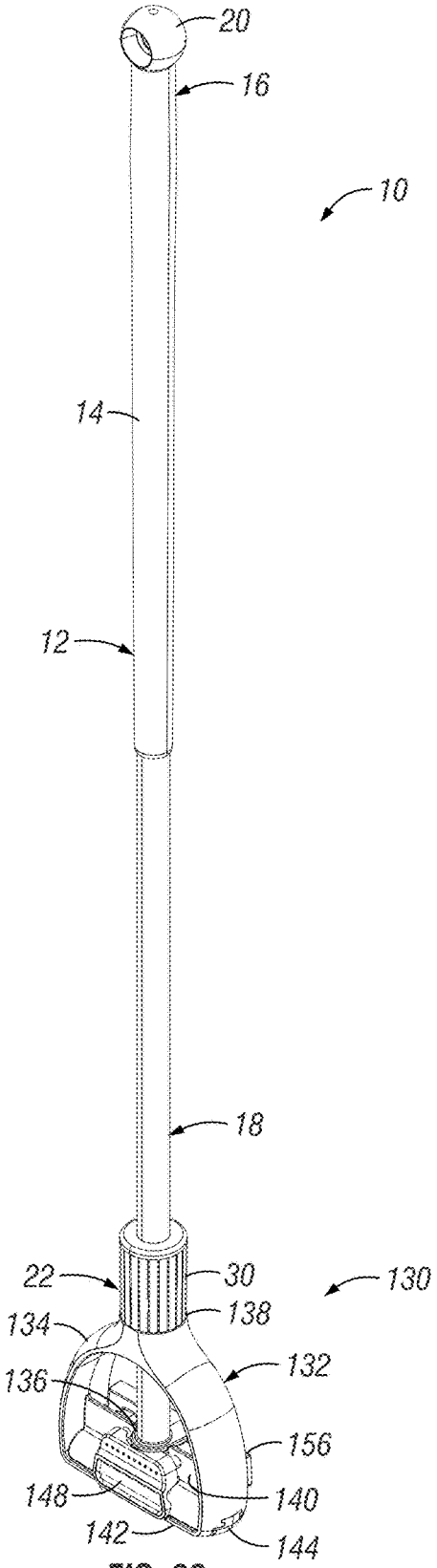
FIG. 23 is a perspective view of another tool assembly.

FIG. 23 shows yet another floor care tool assembly 10 according to aspects of the invention. As shown in FIG. 23, a floor care tool 130 is connected to the handle 12 of the invention. The tool 130 shown in the figure includes many similarities to those previously shown and described. For example, the tool includes a tool head 132 including a tool head body 134. The tool head body 134 includes a generally A-frame shaped components with a bottom portion and upwardly arching side portions. A first connection point 136 includes notches and/or threads 137 for connecting to a portion of the handle 12. In addition, a second connection point 138 includes threads for connecting to a locking cap 30 of the handle. A keyed aperture 146 including a member 147 is included at the second connection point 138 along with threads 139 for interacting with the locking system 22 of the handle 12.

Figure 24:
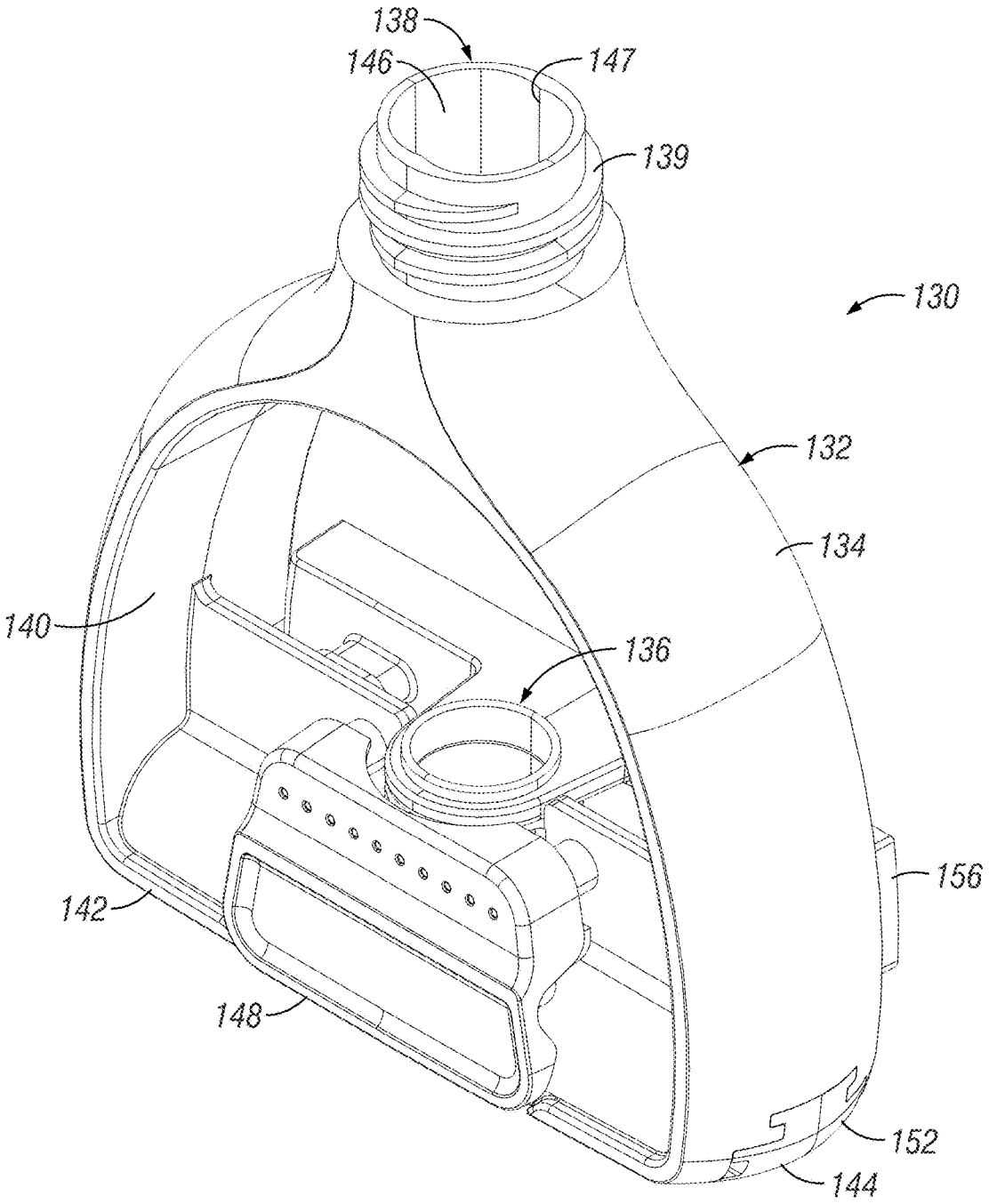
FIG. 24 is a perspective view of a tool head assembly for use with a universal handle according to aspects of the invention.
Figure 25:
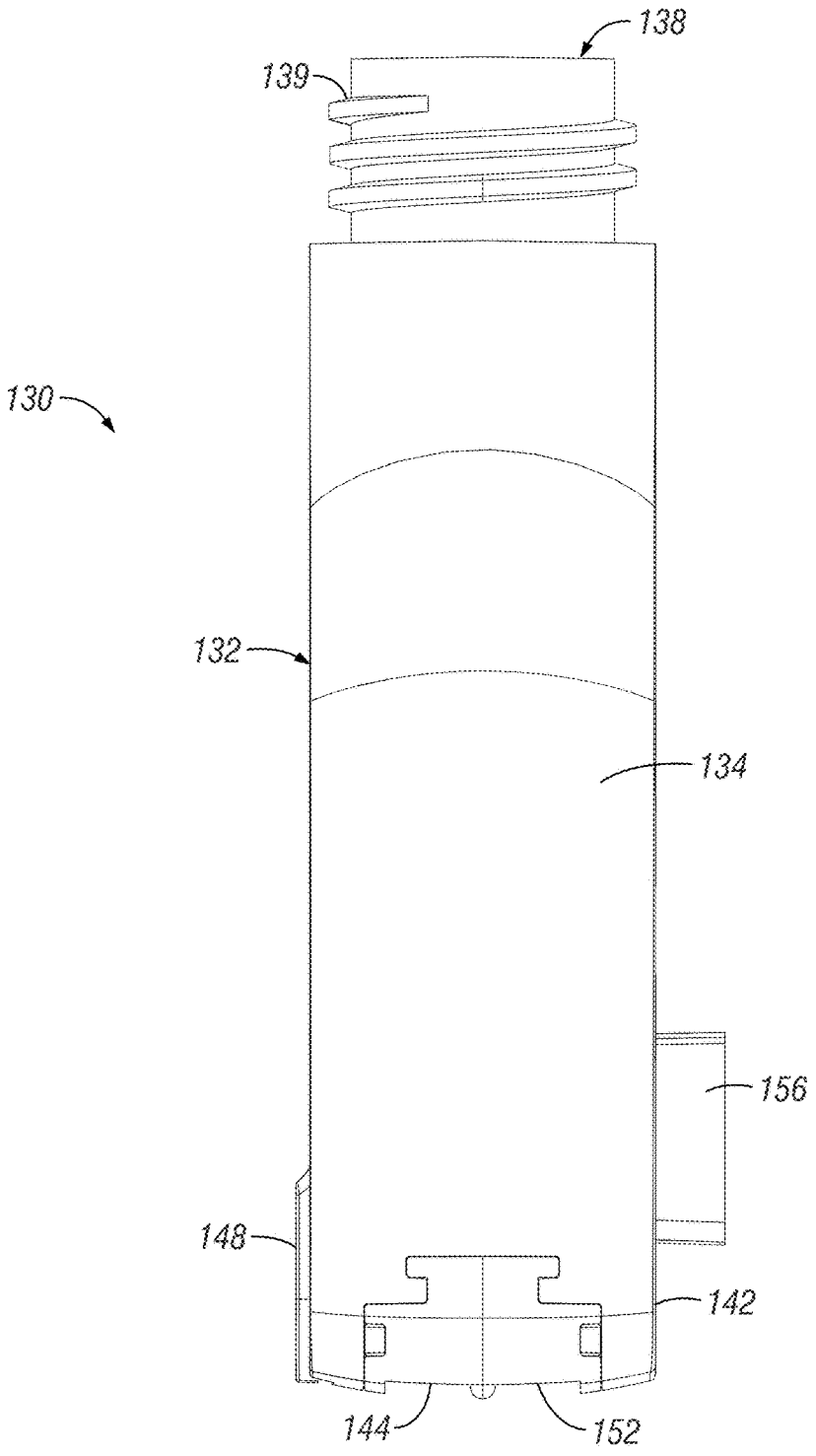
FIG. 25 is a side elevation view of the tool head assembly of FIG. 24.
Figure 26:
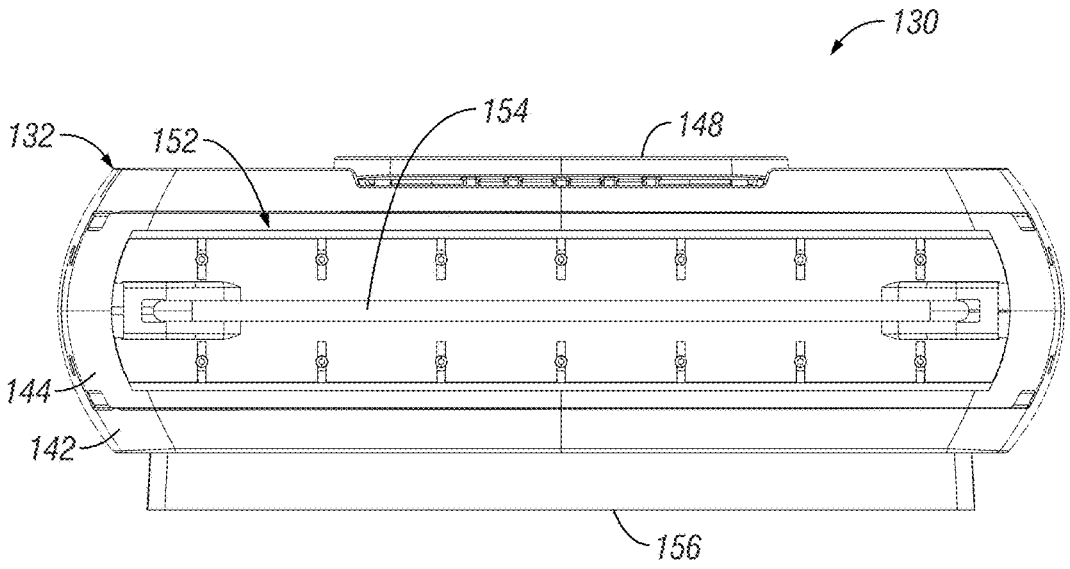
FIG. 26 is a bottom plan view of the tool head assembly of FIG. 24.
Figure 27:
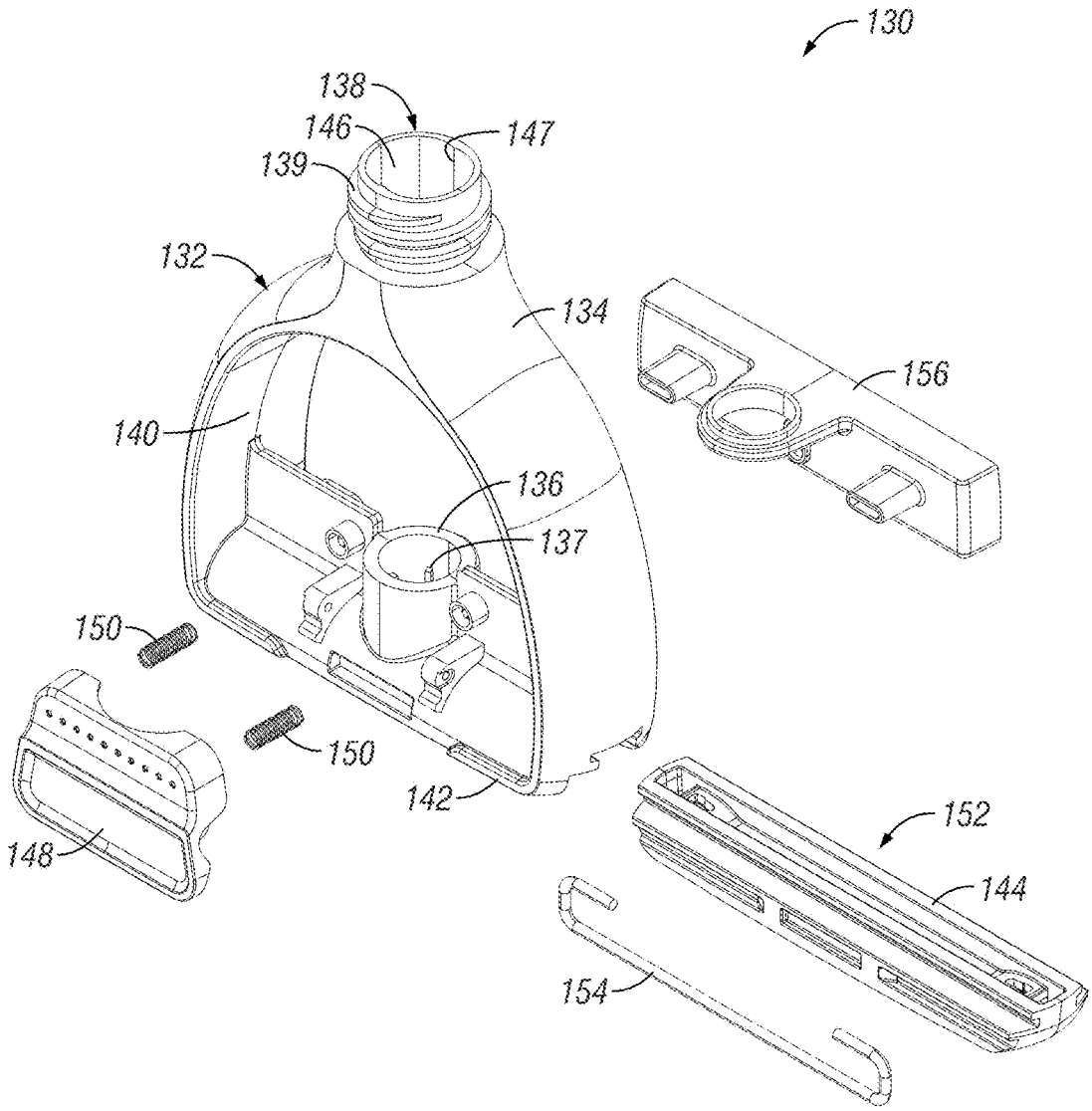
FIG. 27 is an exploded view of the tool head assembly of FIG. 24.

Furthermore, the tool body 134 includes an inner section 140 including a clamp 148 and broom assembly 156 attached to the tool head 132. As shown in FIGS. 24-26, the floor care tool 130 includes both a mop assembly 152 and a broom assembly 156. The broom assembly 156 includes an aperture for being placed at the first connection point 136 of the tool head 132, wherein a portion of the handle 12 extends through the aperture of the broom assembly 156. This will aid in attaching the broom assembly 156 to the tool head 132 in a quick and easy manner. The broom assembly includes a body for receiving a plurality of bristles forming a broom. However, it should be appreciated that other members may be included in a similar manner, including a mop, broom, brush or some combination thereof. Generally any of the cleaning tool types of the invention are contemplated to be attached in a similar manner.

Furthermore, a mop assembly 152 is shown to be connected in the quick release manner to the engaging member attachment 142 of the tool head 132. The mop assembly 152 includes an engaging member 144 for sliding in a slot of the member attachment 142 from either side of the tool head 132. The mop assembly 152 can then be held in place relative to the tool head 132 by use of the clamp 148 being exerted by the springs 150. The clamp will hold the mop assembly 152 in place until such time as the mop assembly 152 is to be removed, such as for replacing the mop head. The clamp can be depressed, allowing the mop assembly 152 to be slid from one of the sides of the tool head 132. The rod 154 is used to secure the mop to the member 144. The use of the mop assembly 152 as shown allows for the removal of said assembly from the tool head for cleaning and/or replacement.

Therefore, the figures show yet another floor care tool 130 in which multiple types of brushes, bristles, mops, squeegees or the like are included with a single tool head 132. In addition to attaching the tools at the engaging member attachment 142, additional members can be attached, such as by insertion of a portion of the handle 12 through a portion of an assembly, such as a broom assembly 156. It should be further appreciated that this need not be the only manner in which an additional tool can be attached to a tool head. However, the additional broom assembly 156 can provide for a multi-tasking floor care tool, in which components can be easily and quickly removed as needed.

Figure 28:
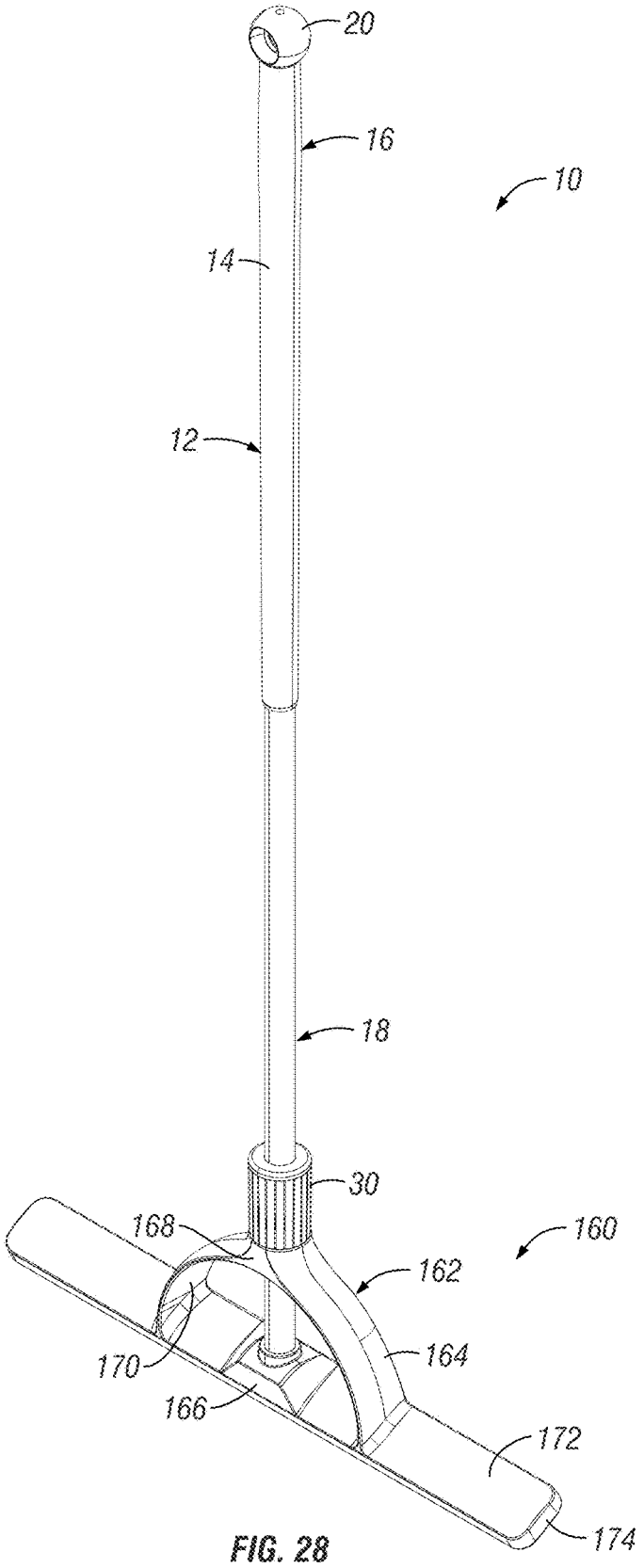
FIG. 28 is a perspective view of another tool assembly.
Figure 29:
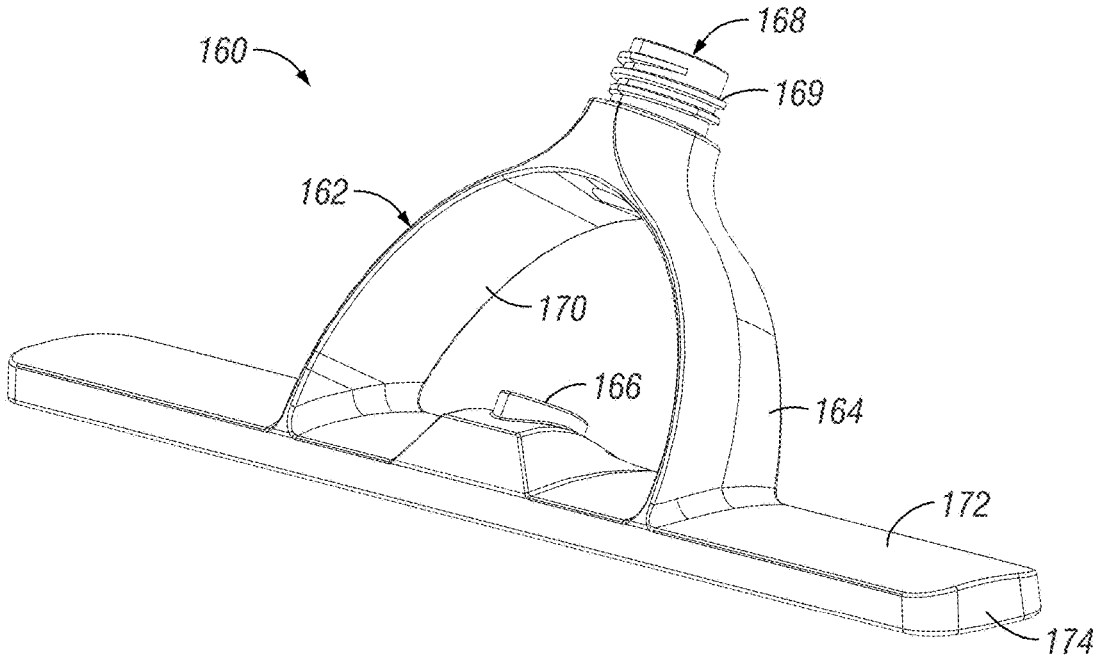
FIG. 29 is a perspective view of a tool head for use with the universal handle of the invention.
Figure 30:
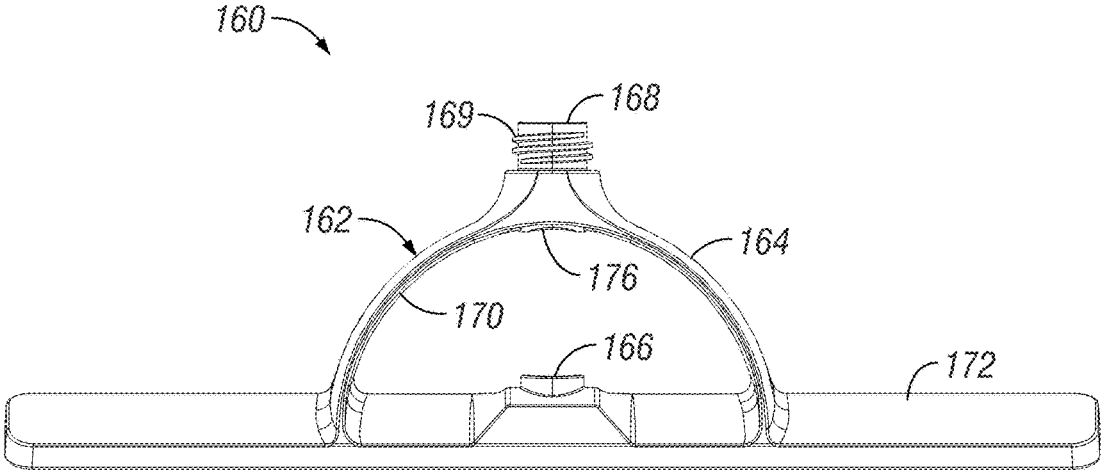
FIG. 30 is a front elevation view of the tool head of FIG. 29.

FIG. 28 shows yet another floor care tool assembly according to aspects of the invention. The floor care tool assembly 10 shown in FIG. 28 includes the universal handle 12 attached to a floor care tool 160. As shown in FIGS. 28-30, the floor care tool 160 includes a tool head 162 having a tool head body 164. The tool head body 164 is again generally A-frame in shape and configuration with a bottom portion in an upwardly extending arch therefrom. The bottom portion, otherwise known as an engaging attachment 172 is larger than those previously shown and described. The floor care tool 160 is shown for use as with a floor broom of the kind known in the art. Therefore, the additional surface area on the underside of the engaging member attachment 172 will provide for a greater number of bristles or brushes attached thereto for use with the broom.

The floor care tool 160 includes the first and second attachment points 166, 168 as previously shown. The first attachment point 166 is a receiving portion for a member of the handle 12 and can at least temporarily affix the portion of the handle to the tool head body 164 thereat. This can be done with the use of internal threads in the tool head 162 and external threaded portions of the handle 12. The second connection point 168 can include external threads 169 and a keyed aperture therethrough. The keyed aperture is used with the keyed locking member of the handle for providing proper alignment and orientation thereof. The external threads 169 can engage the locking cap 30 of the handle 12 to provide for a second connection point such that the handle will have a lesser chance of rotating relative to the floor care tool head 162. Further components of the tool head 162 include an internal portion 170. The inner portion 170 is shown to be generally hollow in the figures; however it is to be appreciated that components, such as weighted components or inserts can be attached thereat to provide for additional weight at the tool head 162.

Furthermore, as has been mentioned, the engaging attachment member 172 includes a larger surface area than those previous disclosed. This can provide for bristles to be attached directly to the underside of the attachment portion 172, in which a larger number of bristles will be included. However, a separate engaging member 174 can also be attached to the underside or a portion of the tool head body 164 as with other components. For example, it is contemplated that bristles be attached to a member, which can be slid into a slot at the bottom attachment portion 172 of the tool head 164. However, other ways of attaching bristles to the underside are included, including but not limited to screwing or otherwise affixing a member with bristles, adhering bristles, or otherwise attaching the bristles to the underside of the tool head 162. The invention is not to be limited to the particular ways and/or methods of attaching the bristles of the broom to the tool head 162.

It is also envisioned that the tool head 162 be of the collapsible type. For example, collapsible mop heads are known and used. Therefore, providing a collapsible styled tool head would provide the added advantage of reducing the amount of space that the tool takes up when not in use.

The foregoing examples of floor care tools provide numerous advantages. For example, it is an object, feature, and/or advantage of the invention to provide tools that will lead to clean and safe floors that can be verified through increased coefficient of friction (COF) readings.

Figure 31:
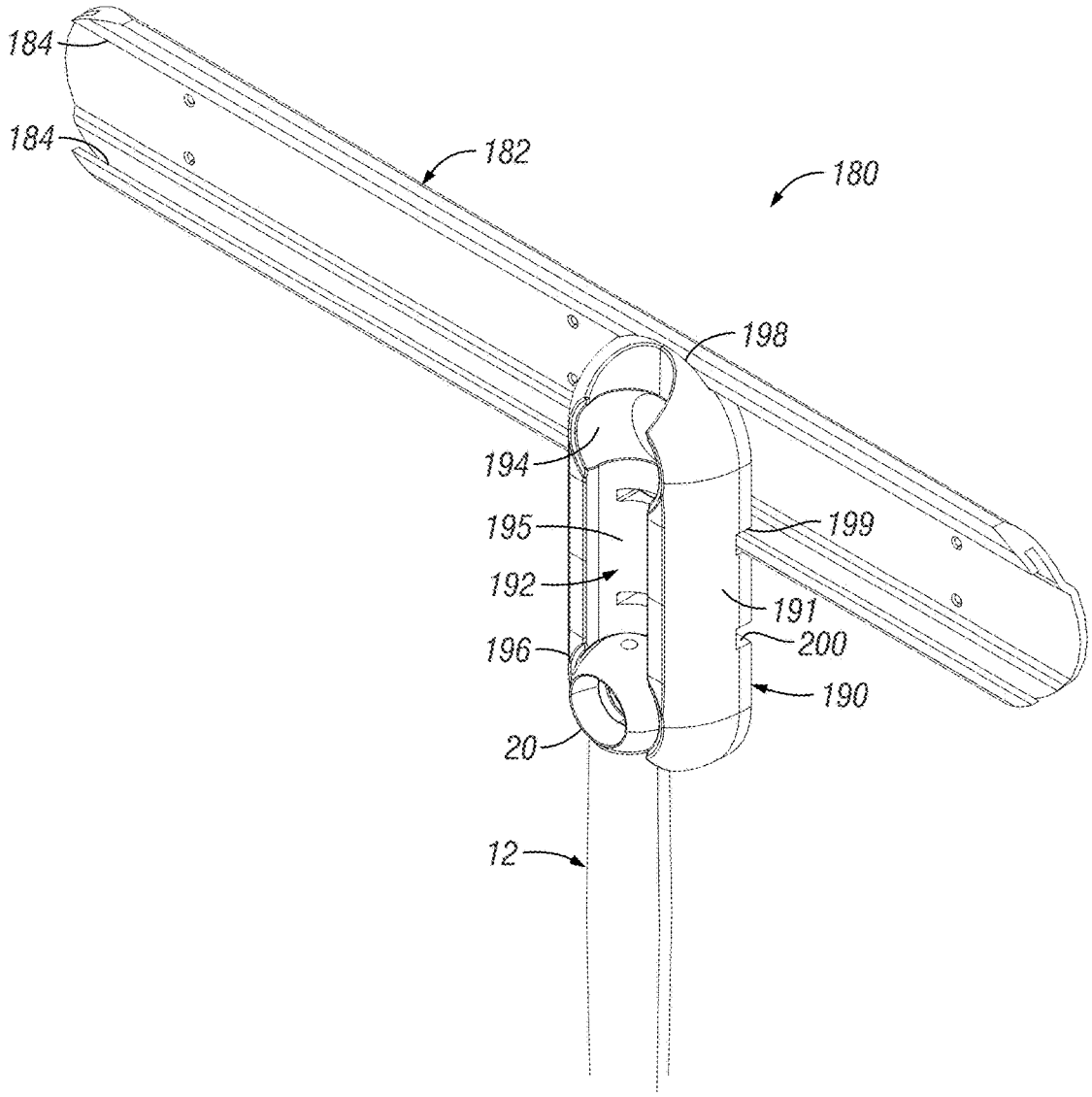
FIG. 31 is a perspective view of a mounting puck and rail for mounting a tool assembly with a tool attached.
Figure 32:
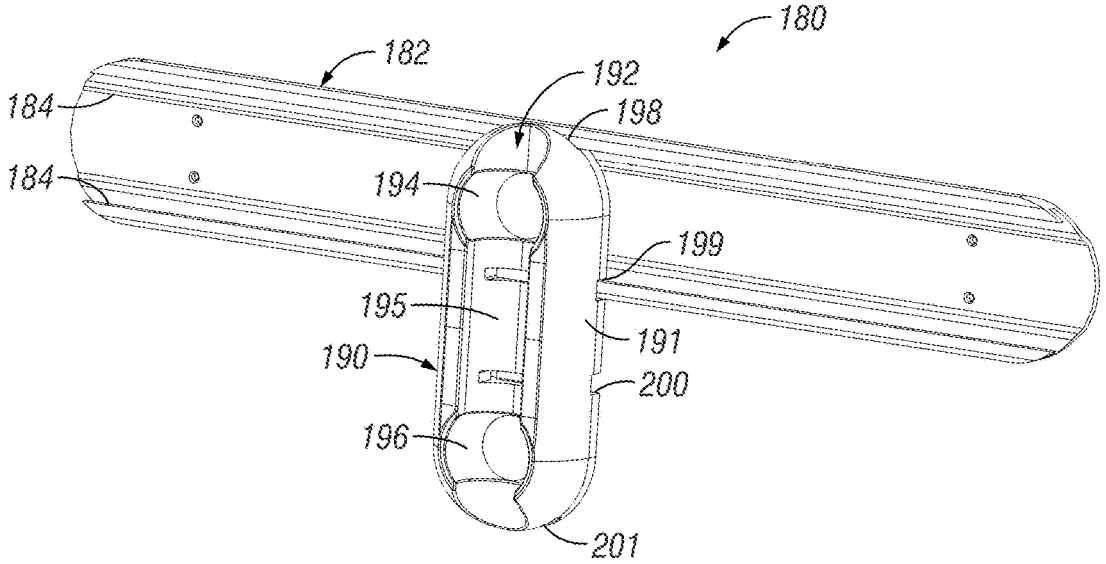
FIG. 32 is a perspective view of a mounting puck and rail for mounting a tool assembly.

FIGS. 31 and 32 disclose a storage or rack system for storing one or more floor care tool assemblies 10, handles 12, or some combination thereof, when not in use. The storage system and/or mounting assembly 180 provide a unique way to hang and store multiple or single tools. The mounting assembly 180 includes a rail 182 with a puck 190 attached thereto. The rail includes channel portions 184, which can interact with notches of a puck 190 to allow the puck to be slid onto and about the rail 182. For example, the puck 190 including a puck body 191 can include a first notch 198, second notch 199, third notch 200 and fourth notch 201. The notches are spaced similar to the rail extrusions such that the notches can fit on and slide about the rail at the notches. In addition, the spacing of the notches allows the puck to be placed in different configurations relative to the rail. For example, while FIGS. 31 and 32 show the first and second notches 198, 199 engaged with the rail 182, it should be appreciated that any adjacent combination of the notches could be fit in the similar manner. This would allow for three different configurations or heights of the puck relative to the rail system. As can be appreciated, the different heights of the puck relative to the rail can allow for staggering of the tools hanging therefrom and thereon, such that the least amount of room is taken up by the non-used floor care assemblies and tools.

Furthermore, the puck body 191 includes a receiving portion or pocket 192. The receiving portion includes potential first, second and third portions 194, 195, 196. The receiving portions interact with the mounting member 20 of the handle, such as shown in FIG. 31, to hold and retain the mounting member therein. Thus, the ball shaped mounting member 20 on the end of the handle 12 fits and/or otherwise snaps into one of the pockets on the puck holder. The multi-position holder can then slide on the rail in different positions to provide various locations and/or heights positioned the handles of the various tools. This allows for flexibility with storage so the heads of the tools do not interfere with one another and do not cross-contaminant one another as well. Thus, as shown in FIG. 1, the mounting member 20 is shown in the third pocket 196 of the puck 190 with the puck positioned generally below the rail 182. This would indicate the tool being in the lower position of the mounting assembly 180. Therefore, positioning a similar puck next to this puck on the rail 182 would be best fit to have the handle with the mounting member 20 at one of the upper portions so as to stagger the height of the floor care tool attached to the adjacent handle and puck. The staggering of the height and location will provide for the best fit for the members. The rail can be an extruded aluminum mounting channel for aligning with the pucks.

Figure 33:
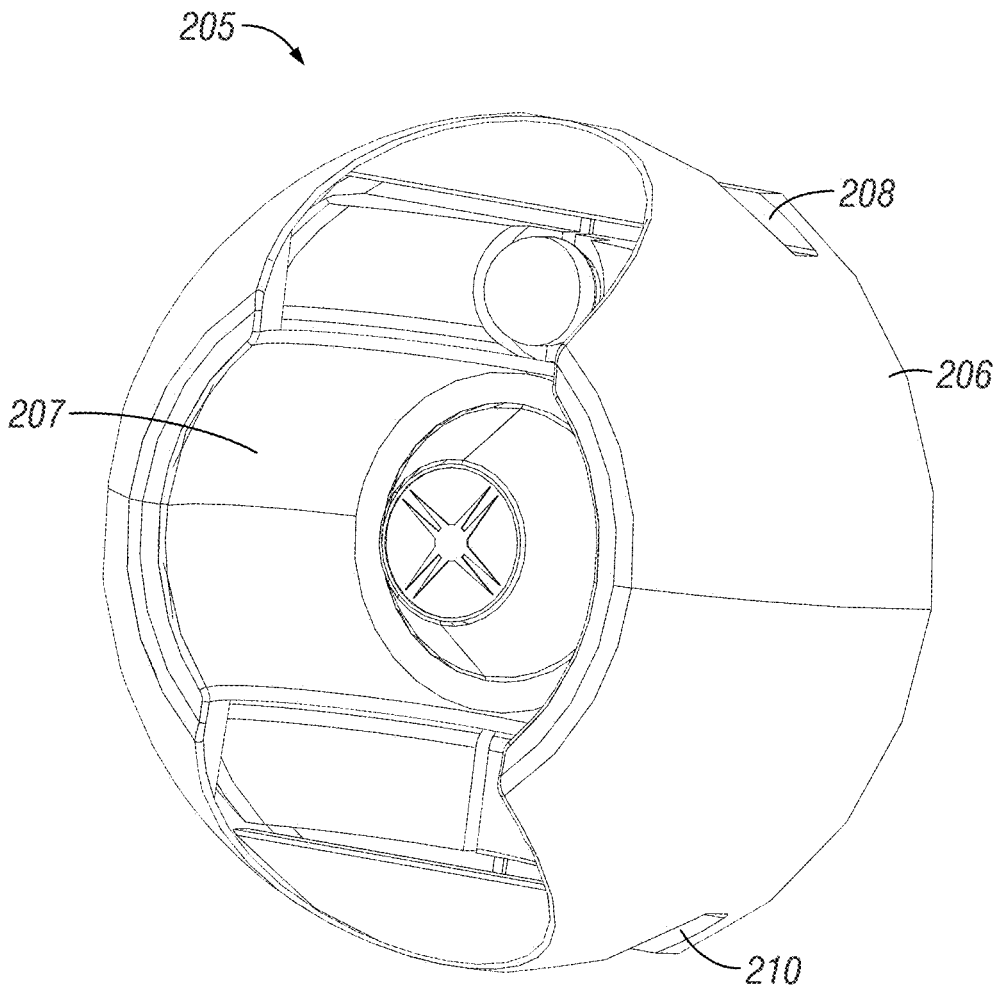
FIG. 33 is a perspective view of a single puck member.
Figure 34:
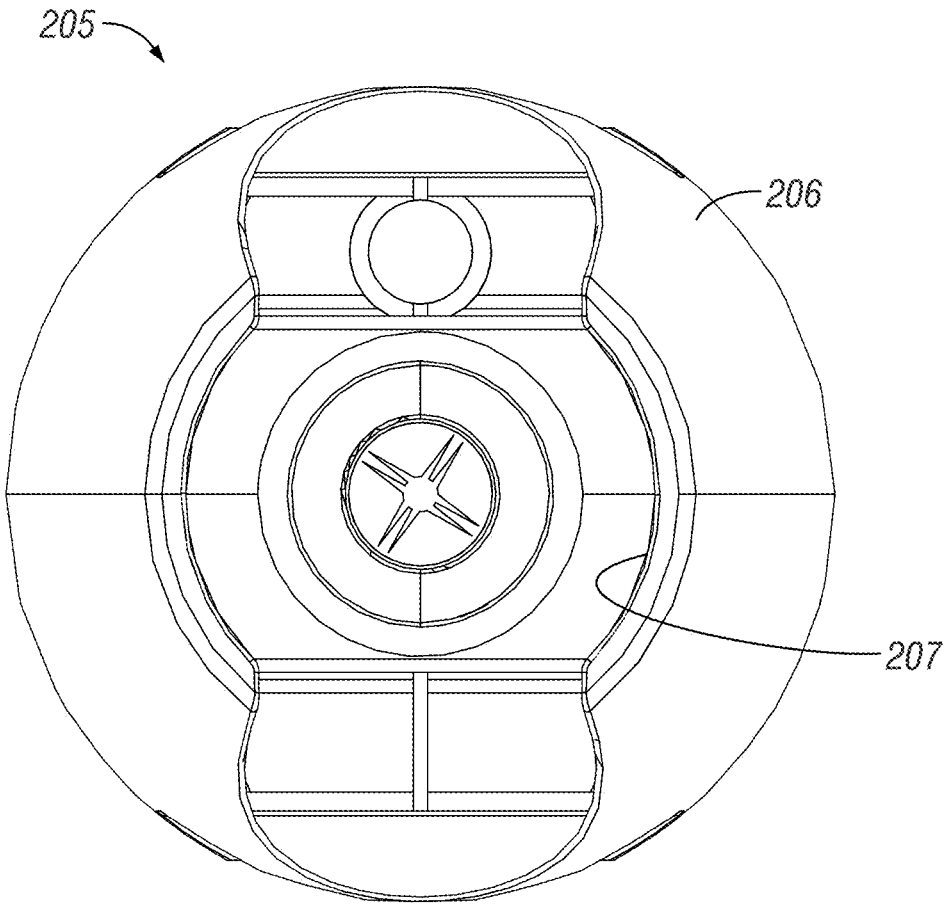
FIG. 34 is a front elevation view of the puck member.
Figure 35:
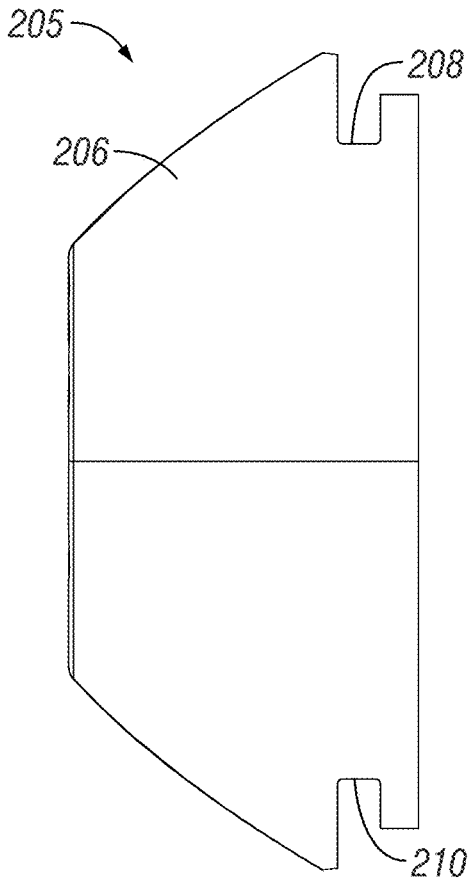
FIG. 35 is a side elevation view of the puck member.

FIGS. 33-35 show yet another aspect of a mounting member for use with any of the various floor care tool assemblies of the invention. A single puck tool 205 is shown in the figures which can be channel mounted to the rail 182, as shown with regard to the puck 190 above. However, the single puck 205 could also be stand-alone mounted for single use applications, such as attached with an adhesive or mechanical fastener to a particular surface or location without the use for rail. Therefore apertures in the single puck could be utilized therefore. However, when used within a channel mounted way with the rail, the puck 205 having a puck body 206 will include first and second notches 208, 210, which are alignable with the extruded channel of the rail 182. This allows the puck to be slid on the rail and to a particular location of choice. A pocket 207 formed in the puck body allows for the receiving of the mounting member 20 of the handle 12 for temporary adhering or otherwise mounting the floor car tool assembly 10 to the puck 205.

Figure 41:
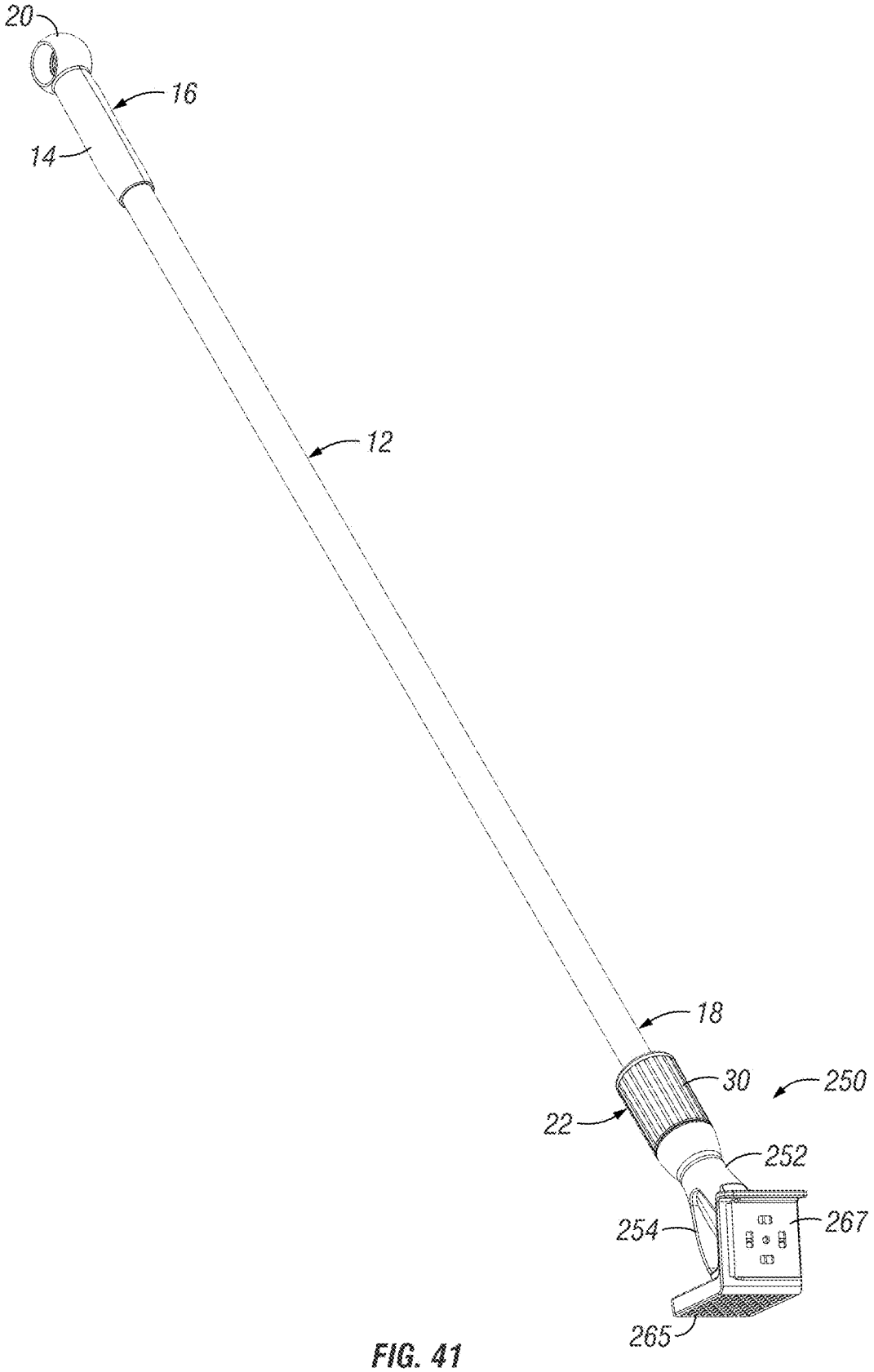
FIG. 41 is a perspective view of a tool assembly including a universal handle and a tool head attached thereto.

FIGS. 41-47 show yet additional aspects of the disclosure. Similar to the tools previously disclosed, the handle 12 and tool combination shown in FIGS. 41-47 includes a tool connected to the handle 12. The handle 12 is similar to that previously disclosed. Attached to the handle 12 in FIG. 41 is a tool 250. The tool 250 includes a tool head body 252 that is attached to the handle 12 via the locking system 22 that includes a first connection point 256 with internal threads/guides/notches, and a second connection point 258 including threads 259. Therefore, the tool will be connected in a similar manner to the other tool heads as included and/or described. Furthermore, utilizing a shorter handle or even a cap with the tool heads of FIGS. 41-47 can provide advantages. As will be understood, the tools could be scrapers or other similar tools. Having a shorter handle would provide for greater control and force for use with the tools.

Figure 42:
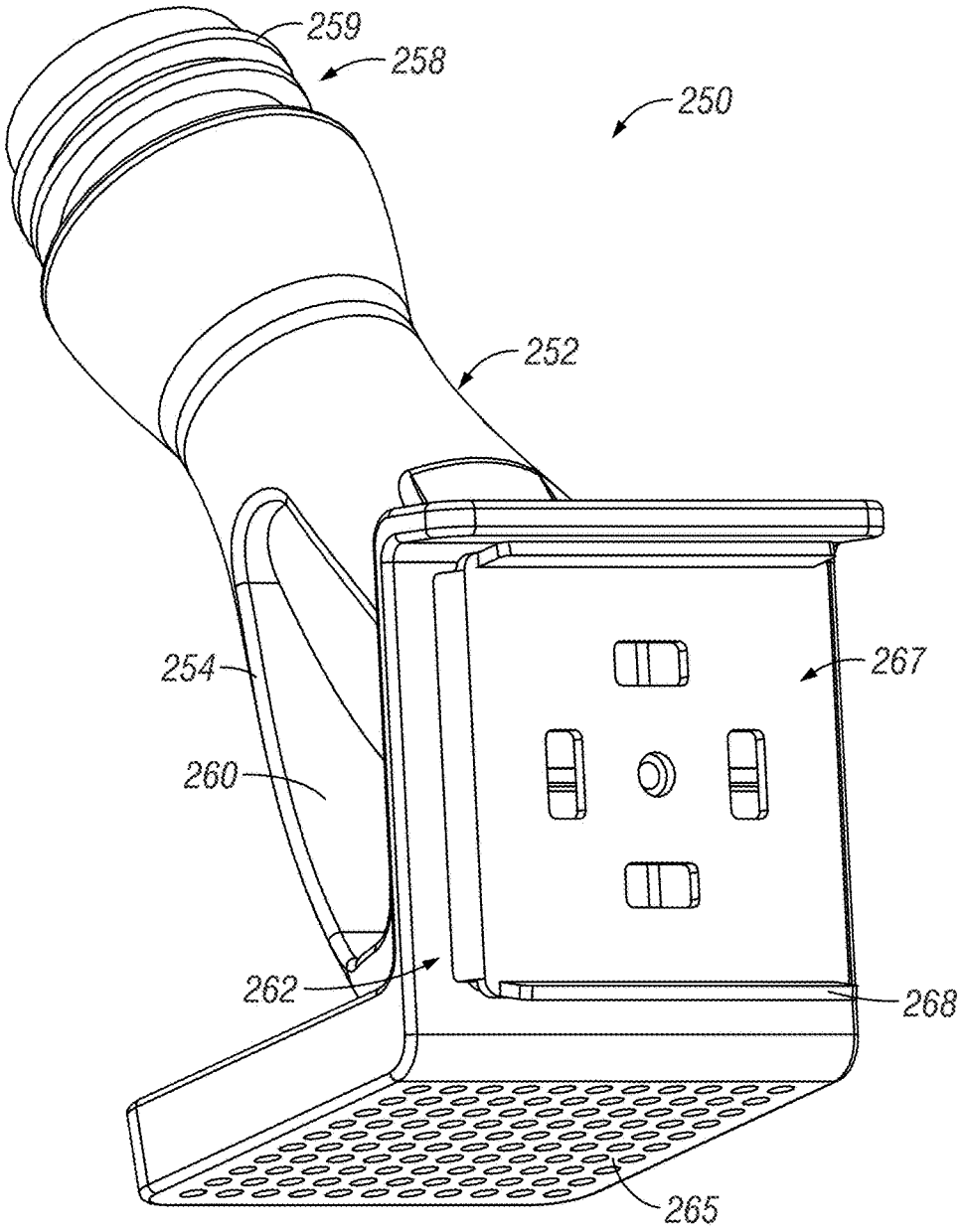
FIG. 42 is a perspective view of a tool head assembly according to aspects of the disclosure.
Figure 43:
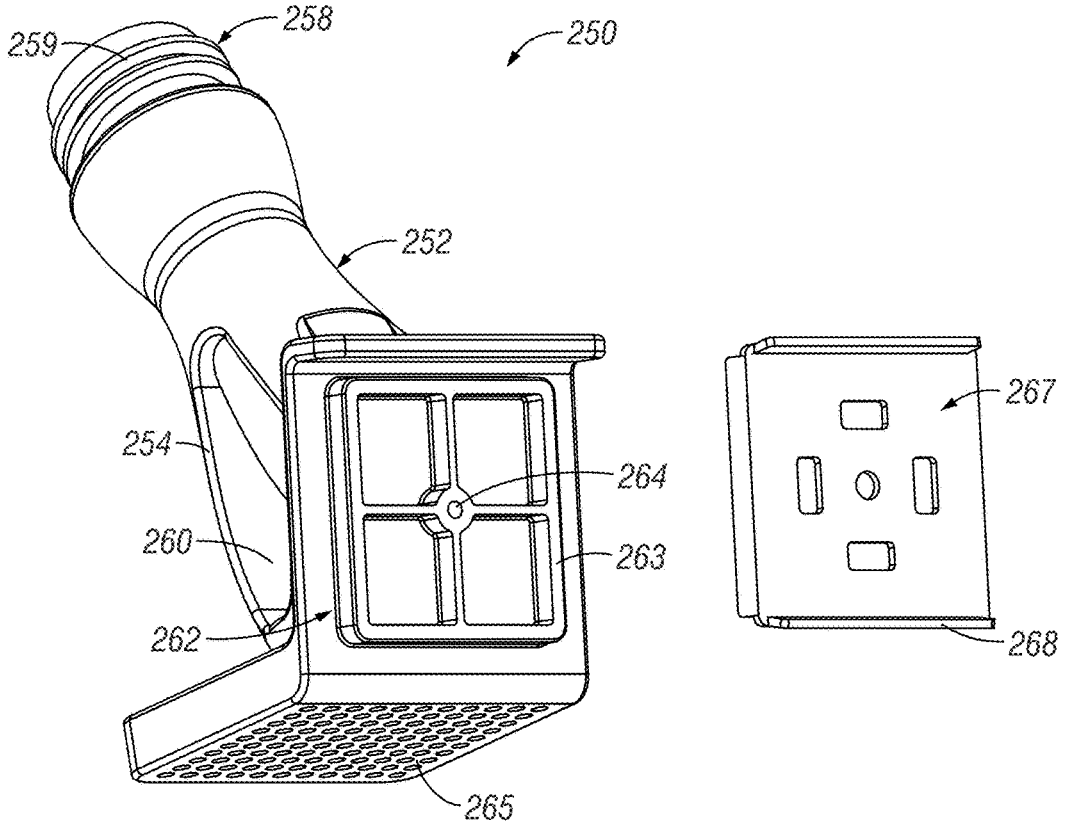
FIG. 43 is an exploded view of the tool head assembly of FIG. 42.
Figure 44:
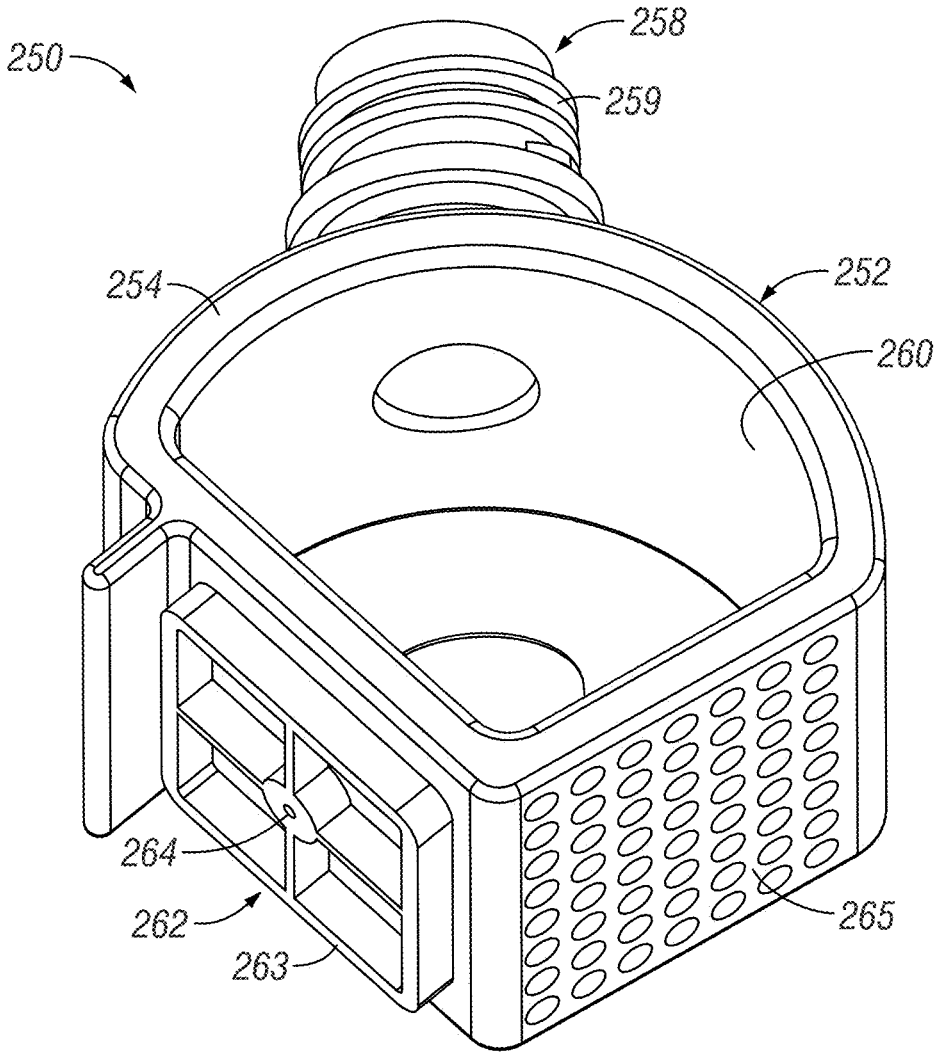
FIG. 44 is a perspective view of another tool head assembly according to aspects of the disclosure.
Figure 45:
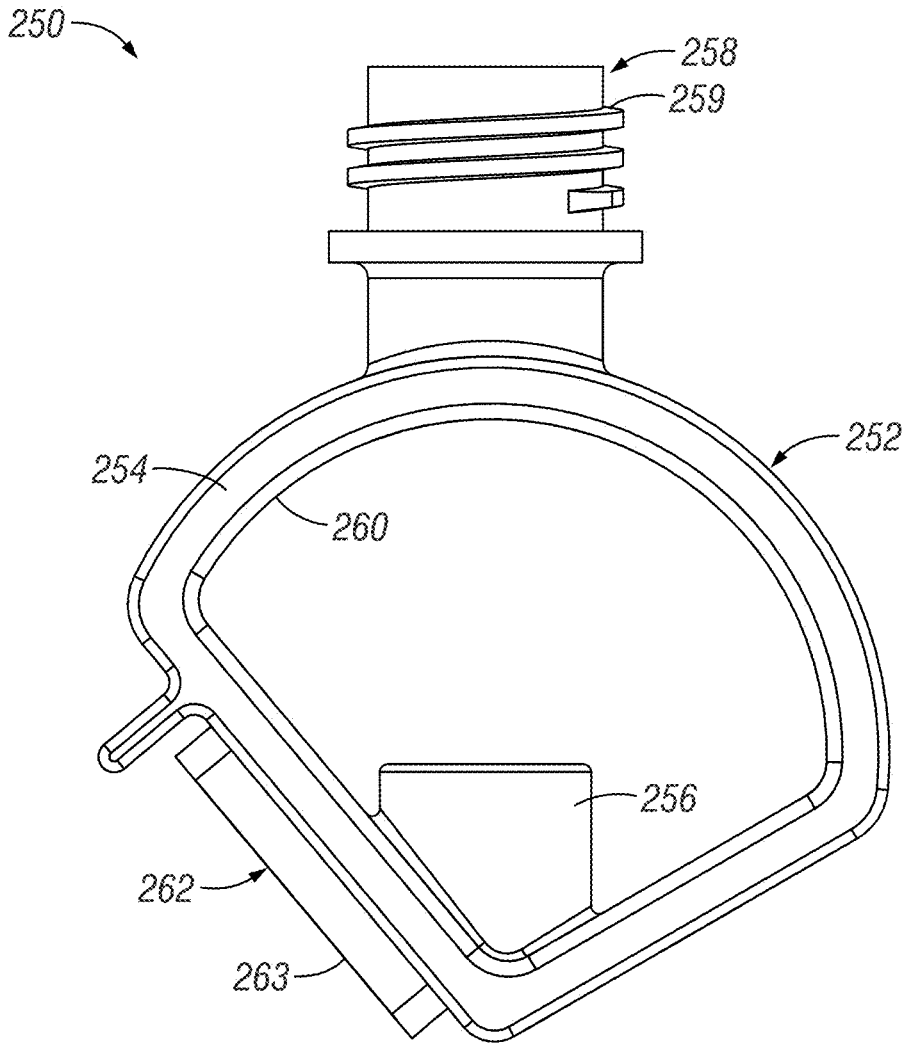
FIG. 45 is a side elevation view of the tool head assembly of FIG. 44.

The tool 250, as shown best in FIGS. 41-43 is a scraping/brushing type tool head that may be used for scraping a surface, such as to remove gum or another substance stuck to the surface. The tool 250 can also include bristles that can be used to scrub or brush the surface, before, during, or after the scraping. Furthermore, as will be understood, multiple scrapers or multiple bristle locations can be mounted on the body 252 to allow for more flexibility and uses of the tool 250.

The tool 250, therefore, includes the tool head 252, bristles attached to or at apertures 265, as well as a scraper attachment 267. As is seen best in FIG. 43, the scraper attachment 267 can be attached to the tool head body 254 at a cleat 262. In some instances, the cleat 262 can be positioned at a front region of the body 254. The cleat 262, according to exemplary aspects, includes one or more ribs 263, and can include a hole 264 or other attachment mechanism. The scraper 267 can include a body that fits on or around the ribs 263 to attach to the tool head 252. In some aspects the scraper or other attachment member can be friction fit to the ribs 263 or can include an adhesive or hook and loop section that secures the scraper 267 to the tool head 252. According to other aspects, the ribs 263 can be used to align the scraper or other member 267 and the member can be secured to the tool head 252, such as by inclusion of a screw or other member passing through the scraper 267 and the hole 264 of the cleat 262.

The scraper 267 includes a body and a blade 268. The blade 268 can comprise rubber, metal, bristles, or generally any other rigid or semi-rigid member that can be used to agitate hard to remove items from a surface. Still further, it is contemplated that the scraper need not be the only member that can be attached to the cleat 262 of the tool head 252. For example, it is contemplated that any member that can be secured to the tool head in order to aid in performing a task can be attached thereto. Such members/applications can include, but are not limited to, pizza brush, pizza cutter, chisel, grill scrapers, grout brush, pool cleaning equipment, painting equipment, window cleaning equipment, shovels, outdoor tools (rakes, snippers, etc.), reaching tools, or the like. The disclosure is not intended to be limited by the list of attachments, and it is to be appreciated that generally any and all attachments that can be used by a user to aid in a process or application are envisioned to be part of the disclosure.

Further aspects of the tool 250 as shown in FIGS. 41-45 and 48-49 include a portion of the tool head body 254 that includes a bristle attachment point, which are shown as bristle apertures 265. Different bristle types can be includes at the location to provide for another location for scrubbing, brushing, cleaning, etc. The bristles can be positioned at an underside of the tool head body 254 to brush an area that has been scraped via the scraper 267 or other attachment. However, it should be appreciated that the type and/or style of bristles/brushes can be generally unlimited.

Figure 46:
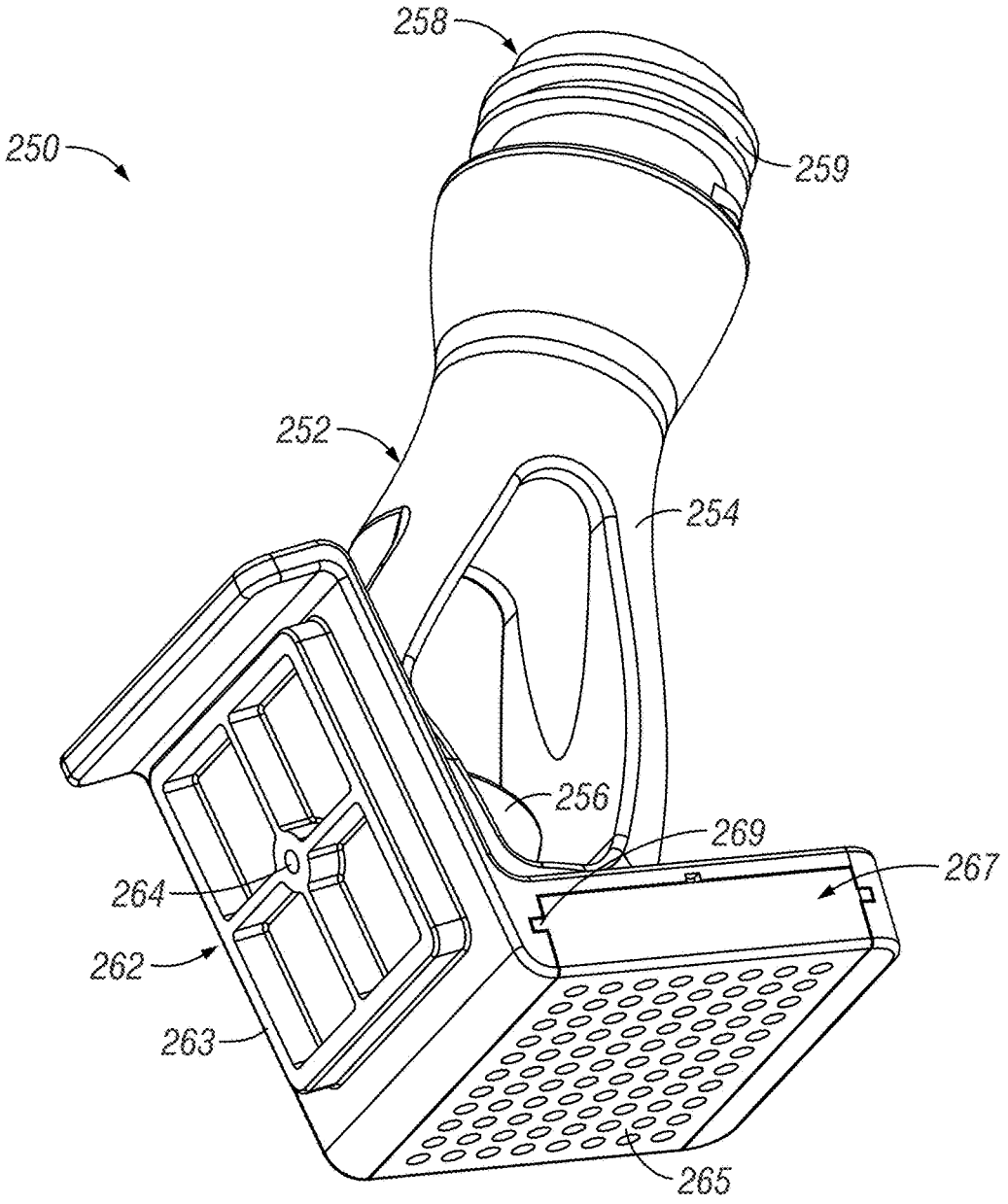
FIG. 46 is a perspective view of another tool head assembly according to aspects of the disclosure.
Figure 47:
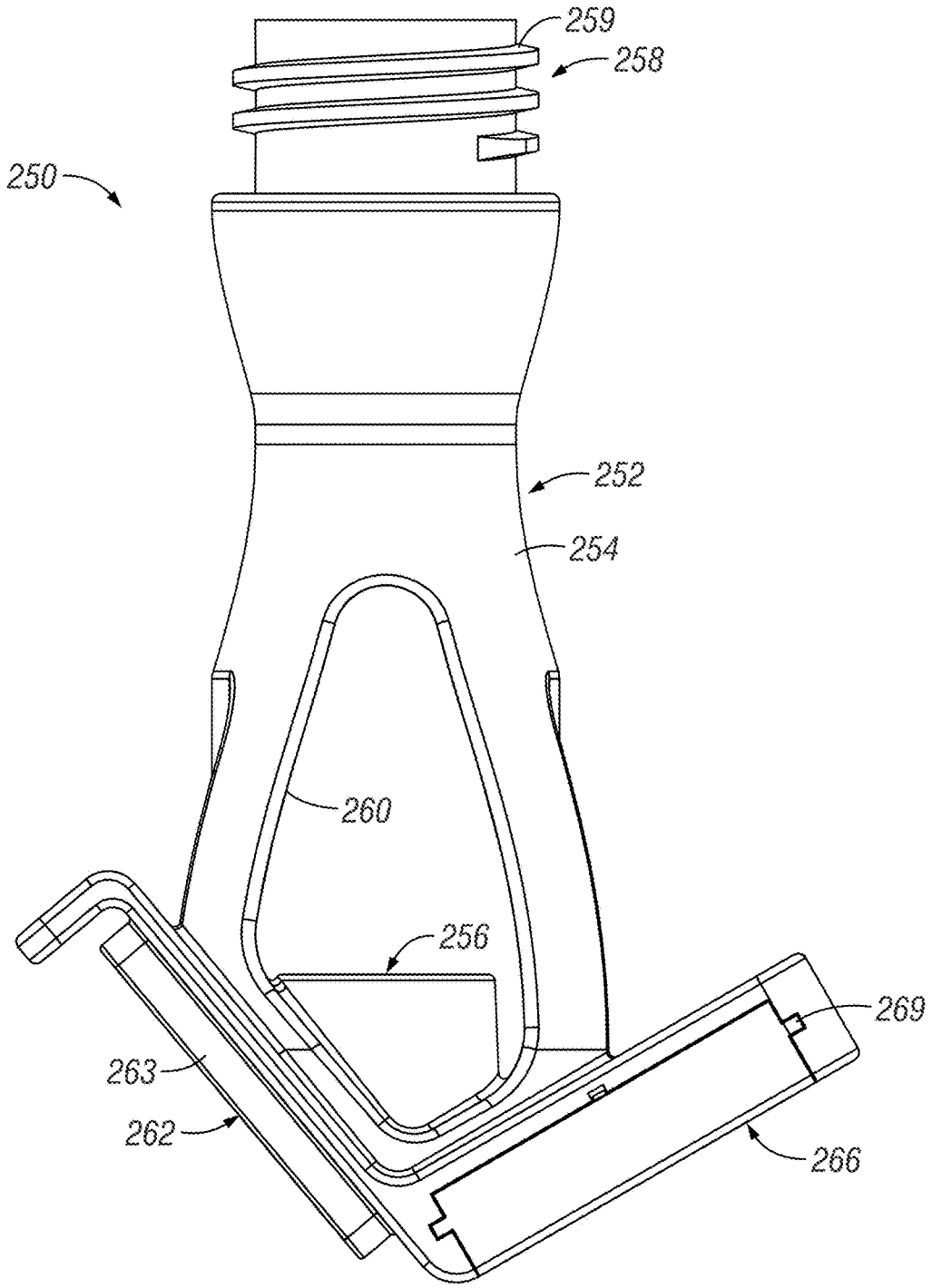
FIG. 47 is a side elevation view of the tool head assembly of FIG. 46.
Figure 48:
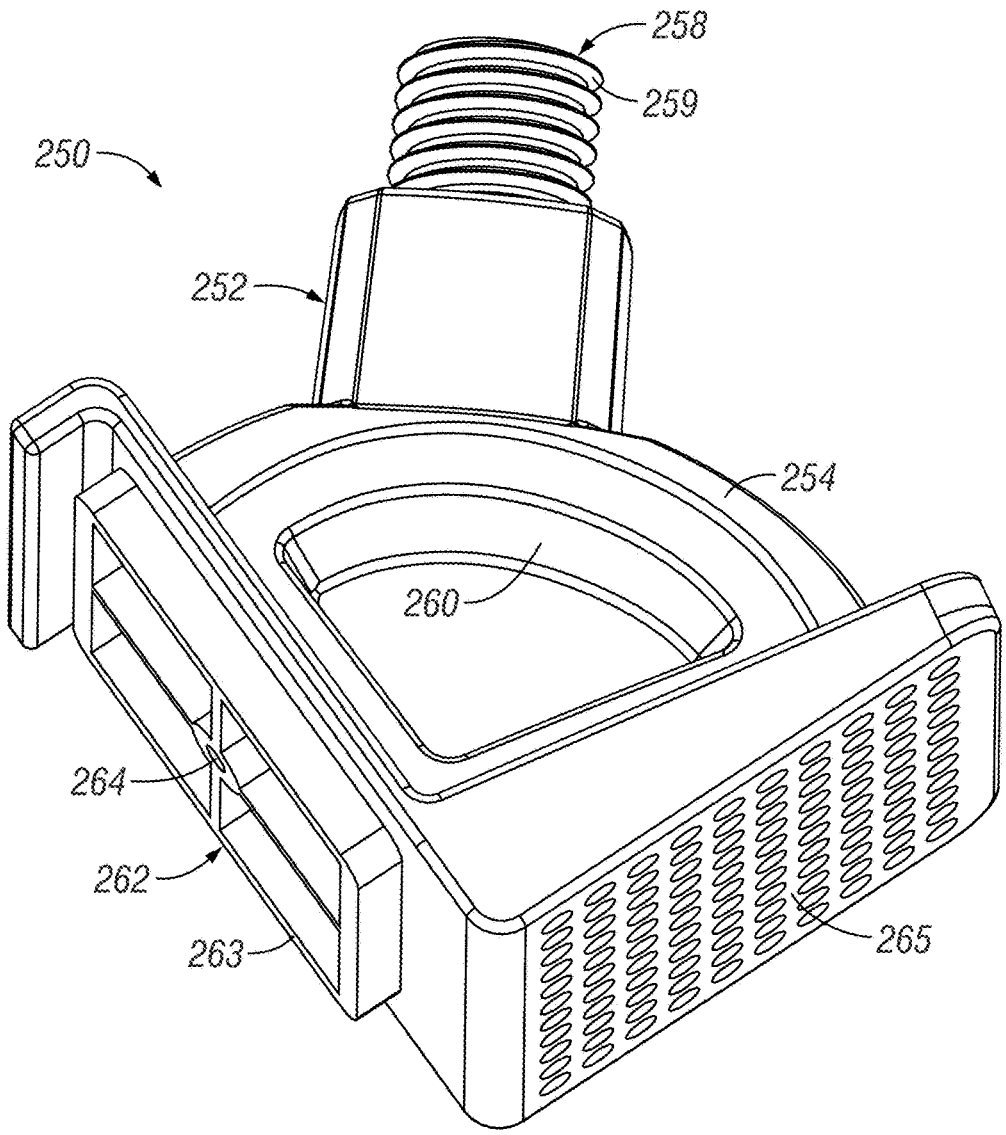
FIG. 48 is a perspective view of another tool head assembly according to aspects of the disclosure.
Figure 49:
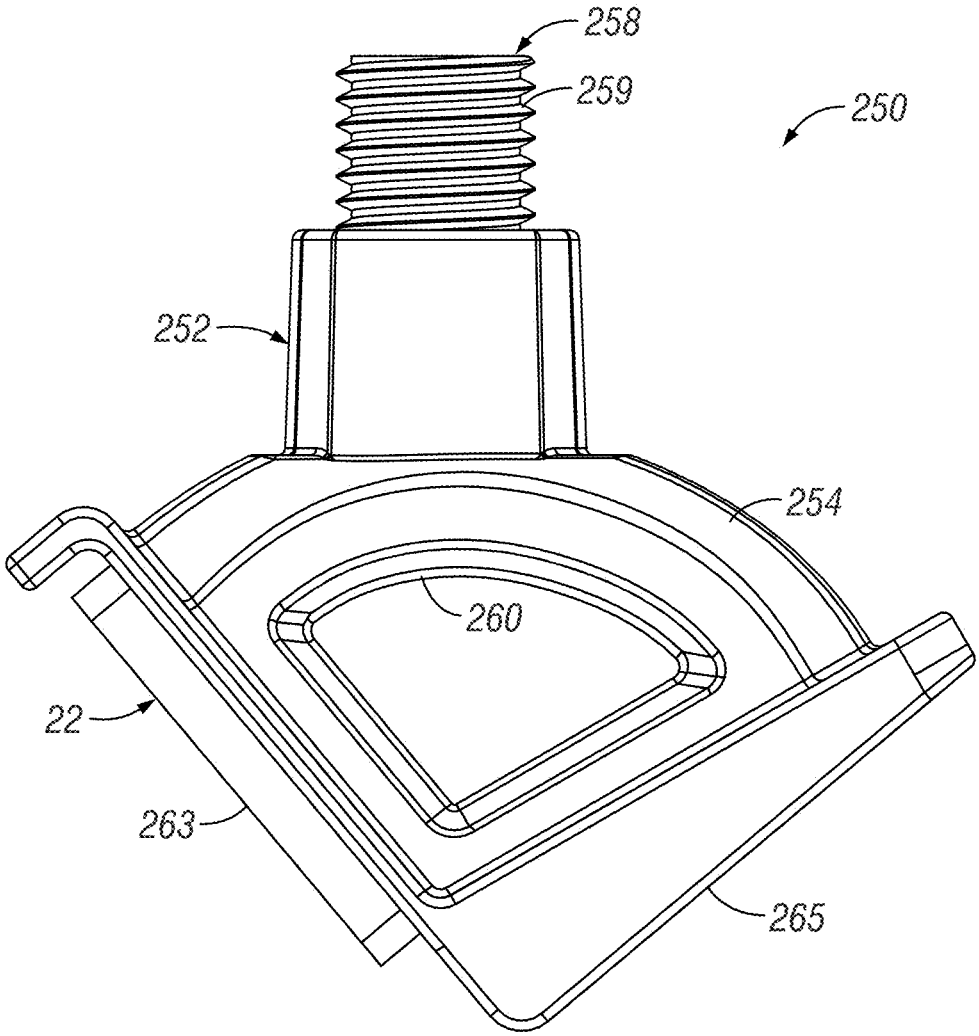
FIG. 49 is a side elevation view of the tool head assembly of FIG. 48.

Yet additional aspects of the disclosure are shown in FIGS. 46-47, which show a tool 250 as has been described. However, the tool 250 includes additional variabilities. The bristles 265 as previously disclosed can be added to a one-piece tool head 252. However, the tool head 252 of FIGS. 46-47 includes a cartridge component 266, which is removable, changeable, and/or replaceable with respect to the tool head 252. For example, it is contemplated that the cartridge 266 include its own application, such as bristles, tools, or the like, which can be used to perform a function. Instead of having to have a specific head for each application, the cartridge 266 can provide for greater flexibility and variability in order to quickly adapt the tool 250 for the desired purpose. The cartridge 266 can be slid relative the tool head body 254 via guides and/or notches 269. The guides 269 provide a path for the cartridge to be inserted to ensure that the cartridge 266 is maintained relative to the tool head 252. Still further, it is contemplated that the cartridge be wider than the tool head body 254, and not substantially flush, as is shown in the figures. A wider cartridge 266 can allow for a larger tool to be added to the tool head 252 in order to perform a different task. The cartridge 266 can be held in place by the guides 269 and/or another locking mechanism, such as a snap, to aid in holding the attached cartridge in place. However, this will still allow for easy and quick replacement for the tool to provide for even greater uses of the tool.

Additional aspects of the disclosure contemplate that the tool head 252 comprise generally any configuration of cleat 262 and/or cartridge 267. For example, it should be appreciated that the tool head 252 includes two cleats, with one being at the location of the cartridge 267 in FIG. 46. Still further, it is contemplated that the cleat 262 be replaced by a second cartridge in some configurations. Even further, it is contemplated that a cleat or cartridge be included with a fixed bristle location on the tool head. The addition of these configurations would allow for even greater flexibility for the tool head, to allow for greater uses with said tool.

It is noted that the tool heads 252 as shown in FIGS. 41-49 are similar, but some may include variations as to their shape. For example, the interior regions 260 may take differing shapes and/or sizes. This design change provides differing structural benefits, but does not change the spirit and/or scope of the tools. Therefore, it is to be appreciated that the tools can function in similar manners.

Therefore, the invention has been shown and described with relation to tools, such as tools for use in cleaning an environment or accomplishing another task. The various aspects of the inventions should be apparent to those skilled in the art, as well as should any variations thereto. For example, while the tools have been shown without any sort of bristles or other attachments, it should be appreciated that any type of bristle, attachment, or cleaning head could be used with any of the various tool head configurations shown and described. Furthermore, combination of bristles, such as the combination of hardness level, length, or other composition of the bristles could be utilized on a single tool head to achieve multiple functions with a similar tool. As mentioned, a tool having longer bristles in a certain location could be used to grout lines or other recessed areas in the ground.

Other materials for aspects of the disclosure can include homopolymer and co-polymer polypropylene (usually polypropylene with some polyethylene added) for the plastic parts. They may have additives to improve stiffness e.g. talc, glass reinforced. And the big bristled blocks are made with a foaming agent to result in very small air bubbles which provides lighter weight. The bristles are most commonly polypropylene or polyester however they could be made from nylon and/or have carbide additives (not common in food service). The textiles (string mops) are essentially all cotton or cotton/rayon blends. The metal handles are powder coated extruded aluminum but could also be powder coated or painted steel.

The various tools have also been shown to be in a generally A-frame shaped manner, with arched side portions extending from a bottom portion. It should be appreciated that this is but one of the potential shapes that the tool heads can take, as the arches, heights, widths, and the like all be changeable. For example, instead of arched side walls, the tool heads could have generally planar walls such that the tool heads form a triangular shape. The arches could also be more pronounced such that the tool head is more circular shaped with the inner section being generally round with a bottom portion. Additional shapes, including the angles, arcs, and the like, could be adjusted to give the tools generally any shape.

The way to attach the various types of floor engaging members (i.e., brushes, mops, squeegees, bristles, combinations, etc.) is also not to be limited. For example, it is contemplated in at least some aspects of the invention to include that the floor engaging members be attached to the tool heads in a "slide in/slide out" manner, where the members are slid into a slotted portion of the tool head. However, the members can also be attached in other ways, such as by adhesives, mechanical fasteners, hook and loops, snaps, frictions fittings, or the like.

Furthermore, additional variations are to be appreciated, such as the ability to adjust the orientation and/or angle of the handle relative to a tool head by selectively aligning one of a plurality of detents with a keyed aperture in the tool head to selectively change the angle between the two. Having the dual connection of the handle and tool head will provide that the handles will not rotate once connected by the dual connections. Furthermore, additional types of inserts and methods of attaching the inserts to the various tool heads can be included as part of the invention to achieve varying results therefrom. While weights, scoops, clamps, and other attachment means have been included, it could be appreciated that additional mechanisms including additional cleaning components including, but not limited to fans, cleaning agents, lights, or other members could be included and activated separately than the bristle members to achieve a greater cleaning for use with the floor care tool. Still further, it should be appreciated while the mounting member of the handle and the mounting assembly have been shown to be a generally ball and socket configuration, it should be appreciated that they can be generally any shape and not just round. The shape of the mounting member can be determined by the type of tool, and/or by ergonomic features to make it easier for use by the user.

Further variations include the addition of an on-board chemistry dispenser. While some aspects of the invention disclose a system for applying chemistry to an area, an additional or other dispenser utilizing a pump and active dispenser (e.g., electric pump) could be included to dispense the chemistry to an area.

Still other benefits, advantages, and the like are to be appreciated by the invention. However, it should be appreciated that the invention provides a manner for having a generally universal and/or modular type over molded, one piece handle, which can be used with a variety and/or plurality of different tool types to provide for different tool assemblies. The structure of the handle and tool heads provide for a more durable type tool assembly that will last longer than those currently in use, which will reduce the overall cost of the user thereof. Being able to switch out an attachment to the tool head may also provide for the reduction in the amount of different tools needed for a particular company, individual, or the like. Still further, the use of inserts indicating the type of use or location of use for the tools can reduce the amount of cross contamination and therefore provide for a cleaner environment for use in the industries of use.

The foregoing description has been presented for purposes of illustration and description, and is not intended to be an exhaustive list or to limit the invention to the precise forms disclosed. It is contemplated that other alternative processes, systems, and assemblies obvious to those skilled in the art are to be considered part of the invention. It is to be understood that the present invention includes numerous advantages, as has been shown and described.

What is claimed is:

1. A universal handle for use with a plurality of tool heads, the handle comprising:

an elongated handle having first and second ends;

a mounting member at the first end of the handle; and a locking system positioned at or near the second end of the handle, the locking system comprising:

a. a keyed locking collar for engaging at least a first portion of the tool head, wherein said locking collar being external to, independent of, and at least partially surrounding the handle; and b. a locking cap rotatably positioned on the handle for engaging a second portion of a tool head, wherein said locking cap surrounding at least a portion of both the handle and the keyed locking collar and being rotatable relative to both the handle and the keyed locking collar while being substantially fixed about a longitudinal length of the handle;

wherein said keyed locking collar comprises one or more grooves and said locking cap comprises protrusions aligned with said grooves to allow the locking cap to rotate relative to the keyed locking collar and to keep the locking cap substantially fixed about the longitudinal length of the handle.

2. The universal handle of claim 1, wherein the locking cap comprises an internal engagement member for attaching to the second portion of the tool head.

3. The universal handle of claim 2, wherein the internal engagement of the locking cap comprises an internal thread.

4. The universal handle of claim 1, wherein the keyed locking collar comprising at least one detent for aligning with the first portion of the tool head, said detent used to orient the handle relative to the tool head.

5. The universal handle of claim 4, wherein said keyed locking collar is affixed to the elongated handle at a location at or near the second end.

6. The universal handle of claim 1, wherein said locking cap at least partially surrounds a portion of the keyed locking collar in the groove(s) of the keyed locking collar.

7. The universal handle of claim 6, wherein said locking cap comprising first and second portions attached to another around the keyed locking collar.

8. The universal handle of claim 1, wherein the elongated handle is overmolded.

9. A tool assembly for use with cleaning, the assembly comprising:

a universal handle comprising an elongated handle having first and second ends, a mounting member at the first end, and a locking system positioned at or near the second end of the handle, the locking system comprising a keyed locking collar for engaging at least a first portion of a tool head, wherein said locking collar being external to, independent of, and at least partially surrounding the handle, and a locking cap rotatably positioned on the handle for engaging a second portion of a tool head, wherein said locking cap surrounding at least a portion of both the handle and the keyed locking collar and being rotatable relative to both the handle and the keyed locking collar while being substantially fixed about a longitudinal length of the handle;

wherein said keyed locking collar comprises one or more grooves and said locking cap comprises protrusions aligned with said grooves to allow the locking cap to rotate relative to the keyed locking collar and to keep the locking cap substantially fixed about the longitudinal length of the handle; and a tool operatively attached to the universal handle, the tool comprising a head member comprising a body and including first and second connection points for connecting the head member to the universal handle, and at least one engaging member attachment operatively connected to the head member for selectively attaching one of a plurality of engaging members to the head member.

10. The assembly of claim 9, wherein at least a portion of the universal handle is positioned through the second connection point of the tool and operatively positioned at the first connection point thereof.

11. The assembly of claim 9, further comprising a tool insert positioned within a substantially hollow portion of the tool body.

12. The assembly of claim 11, wherein the tool insert comprises:

a. a reservoir;

b. a weighted member;

c. a light; or d. a battery.

13. The assembly of claim 12, further comprising bristles operatively attached to the tool body in the form of a deck brush.

* * * * *